US010233700B2

(12) United States Patent
Murray et al.

(10) Patent No.: US 10,233,700 B2
(45) Date of Patent: Mar. 19, 2019

(54) DOWNHOLE DRILLING MOTOR WITH AN ADJUSTMENT ASSEMBLY

(71) Applicant: APS Technology, Inc., Wallingford, CT (US)

(72) Inventors: Bill Murray, Tomball, TX (US); David Holdman, Kingwood, TX (US); Mark Ellsworth Wassell, Houston, TX (US)

(73) Assignee: APS Technology, Inc., Wallingford, CT (US)

( * ) Notice: Subject to any disclaimer, the term of this patent is extended or adjusted under 35 U.S.C. 154(b) by 691 days.

(21) Appl. No.: 14/675,378

(22) Filed: Mar. 31, 2015

(65) Prior Publication Data

US 2016/0290050 A1 Oct. 6, 2016

(51) Int. Cl.
*E21B 7/06* (2006.01)
*E21B 4/00* (2006.01)
*E21B 17/10* (2006.01)

(52) U.S. Cl.
CPC ..... *E21B 17/1064* (2013.01); *E21B 7/067* (2013.01)

(58) Field of Classification Search
CPC ..... E21B 17/1064; E21B 7/067
See application file for complete search history.

(56) References Cited

U.S. PATENT DOCUMENTS 2,345,766 A * 4/1944 Miller ..... E21B 7/067 175/256
2,906,143 A 9/1959 Muser
3,062,303 A * 11/1962 Schultz ..... E21B 7/062 166/117.5
3,092,188 A 6/1963 Farris
3,255,627 A 6/1966 Doig et al.
3,466,597 A 9/1969 Richter, Jr. et al.
3,650,338 A 3/1972 McNeely
3,825,081 A 7/1974 McMahon
3,903,974 A 9/1975 Cullen
3,968,473 A 7/1976 Patton et al.
4,220,213 A 9/1980 Hamilton
(Continued)

FOREIGN PATENT DOCUMENTS

EP 0 530 045 3/1993
EP 0 540 045 5/1993
(Continued)

OTHER PUBLICATIONS

U.S. Appl. No. 60/676,072, filed Apr. 29, 2005, Martin E. Cobern.
(Continued)

*Primary Examiner* — James G Sayre
(74) *Attorney, Agent, or Firm* — Offit Kurman, P.A.; Gregory A. Grissett

(57) ABSTRACT

An embodiment includes a downhole motor configured to operate a drill bit to drill a well into an earthen formation. The downhole motor includes a motor housing, a stator supported by an inner surface of the motor housing, a rotor operably coupled to the stator. The rotor is configured to be operably coupled to the drill bit. The motor housing includes an uphole portion, a bend, and a downhole portion that extends relative to bend away from the uphole portion in a downhole direction. The downhole motor includes an adjustment assembly that can guide the direction of drilling.

36 Claims, 14 Drawing Sheets

(56) References Cited

U.S. PATENT DOCUMENTS 4,303,994 A 12/1981 Tanguy
4,305,474 A * 12/1981 Farris ..... E21B 4/02 175/107
4,319,649 A 3/1982 Jeter
4,324,297 A 4/1982 Denison
4,343,369 A 8/1982 Lyons et al.
4,359,898 A 11/1982 Tanguy et al.
4,445,578 A 5/1984 Millheim
4,479,564 A 10/1984 Tanguy
4,507,735 A 3/1985 Moorehead et al.
4,608,861 A 9/1986 Wachtler et al.
4,638,873 A 1/1987 Wellborn
4,709,726 A 1/1987 Fitzgibbons et al.
4,662,458 A 5/1987 Ho
4,715,451 A 12/1987 Bseisu et al.
4,732,223 A 3/1988 Schoeffler et al.
4,739,843 A 4/1988 Burton
4,760,735 A 8/1988 Sheppard et al.
4,802,143 A 1/1989 Smith
4,821,563 A 4/1989 Maron
4,884,643 A * 12/1989 Wawrzynowski ..... E21B 7/067 166/237
4,958,125 A 9/1990 Jardine et al.
4,958,517 A 9/1990 Maron
5,048,621 A * 9/1991 Bailey ..... E21B 7/067 175/256
5,052,501 A * 10/1991 Wenzel ..... E21B 7/067 175/61
5,117,927 A * 6/1992 Askew ..... E21B 7/067 175/325.2
5,125,463 A * 6/1992 Livingstone ..... E21B 7/067 166/237
5,131,479 A 7/1992 Boulet
5,168,943 A * 12/1992 Falgout, Sr. ..... E21B 7/067 175/256
5,193,628 A 3/1993 Hill et al.
5,251,708 A 10/1993 Perry et al.
5,311,953 A * 5/1994 Walker ..... E21B 7/067 175/107
5,363,095 A 11/1994 Normann et al.
5,386,724 A 2/1995 Das et al.
5,419,405 A 5/1995 Patton
5,813,480 A 9/1998 Zaleski et al.
5,857,531 A * 1/1999 Estep ..... E21B 4/02 175/101
6,050,346 A 4/2000 Hipp
6,057,784 A 5/2000 Schaaf et al.
6,068,394 A 5/2000 Dublin
6,089,332 A 7/2000 Barr et al.
6,102,681 A 8/2000 Turner
6,105,690 A 8/2000 Biglin, Jr. et al.
6,213,205 B1 * 4/2001 Surjaatmadja ..... E21B 7/067 166/242.2
6,216,802 B1 4/2001 Sawyer
6,230,823 B1 5/2001 Sieniawski
6,244,361 B1 6/2001 Comeau et al.
6,257,356 B1 7/2001 Wassell
6,321,857 B1 11/2001 Eddison
6,328,119 B1 12/2001 Gillis
6,392,561 B1 5/2002 Davies
6,427,783 B2 8/2002 Krueger et al.
6,554,083 B1 * 4/2003 Kerstetter ..... E21B 7/067 175/107
6,595,303 B2 7/2003 Noe
6,626,254 B1 9/2003 Krueger
6,659,200 B1 12/2003 Eppink
6,714,138 B1 3/2004 Turner
6,799,646 B1 * 10/2004 Daigle ..... E21B 7/067 175/256
6,802,215 B1 10/2004 Boucher et al.
6,808,027 B2 10/2004 McLoughlin et al.
6,913,095 B2 7/2005 Kruger
7,013,994 B2 3/2006 Eddison
7,327,634 B2 2/2008 Perry
7,389,830 B2 6/2008 Turner et al.
7,503,408 B2 3/2009 Walker et al.
7,556,105 B2 7/2009 Krueger
7,681,663 B2 3/2010 Cobern
7,762,356 B2 7/2010 Turner
7,942,214 B2 5/2011 Johnson et al.
7,999,695 B2 8/2011 Rodney et al.
8,011,452 B2 9/2011 Downton
8,087,477 B2 1/2012 Sullivan et al.
8,087,479 B2 1/2012 Kulkarni et al.
8,157,025 B2 * 4/2012 Johnson ..... E21B 7/067 175/101
8,205,686 B2 6/2012 Beuershausen
8,397,562 B2 3/2013 Wassell et al.
8,534,385 B2 9/2013 Malcolm
8,590,636 B2 11/2013 Menger
2001/0052428 A1 * 12/2001 Larronde ..... E21B 7/062 175/61
2002/0070050 A1 6/2002 Wassell
2004/0016571 A1 1/2004 Kruegar
2004/0262043 A1 12/2004 Schuaf
2005/0109097 A1 5/2005 Bogath et al.
2005/0150689 A1 7/2005 Jogi et al.
2006/0215491 A1 9/2006 Hall
2006/0260843 A1 11/2006 Cobern
2007/0095575 A1 * 5/2007 Johnson ..... E21B 7/067 175/74
2008/0099247 A1 * 5/2008 Andoskin ..... E21B 7/067 175/74
2008/0197732 A1 * 8/2008 Cioceanu ..... E21B 7/067 310/89
2010/0006341 A1 1/2010 Downton
2010/0032212 A1 2/2010 Van Steenwyk et al.
2014/0131106 A1 5/2014 Coull
2015/0218934 A1 8/2015 Turner

FOREIGN PATENT DOCUMENTS

EP 0 770 760 5/1997
EP 0 874 128 10/1998
EP 0 904 478 8/2000
GB 2 259 316 3/1998
GB 2 343 470 5/2000
GB 2 408 526 6/2005
GB 2 410 042 7/2005
GB 2 427 222 12/2006
WO WO 1997-047848 12/1997
WO WO 2001-025586 4/2001
WO WO 2001-046549 6/2001
WO WO 2002-059447 8/2002
WO WO 2003-076760 9/2003
WO WO 2005-028805 3/2005
WO WO 2009-129386 10/2009

OTHER PUBLICATIONS

Catalog. Schlumberger, Power Drive Vortex, Rotary Steerable System for Supercharged Drilling, Mar. 2005, 5 pgs.
Catalog. Schlumberger, Power Drive Xtra Series, Complete Series of Rotary Steerable Systems for Reduced Well Construction Cost, Oct. 2002, 7 pages.
Durant, Slimhole Rotary Steerable System Now a Reality, Drilling Contractor, Jul.-Aug. 2002_pp. 24-25.
In the United States Patent and Trademark Office, In Re: U.S. Appl. No. 11/117,802 Non-Final Office Action dated May 15, 2007.
International Application No. PCT/US2013/069054; International Search Report dated Apr. 23, 2014, 15 pages.
International Application No. PCT/US2015/014312: International Search Report and Written Opinion dated Sep. 17, 2015, 18 pages.
In the United States Patent and Trademark Office, In Re: U.S. Appl. No. 09/734,983, Non-final Office Action dated Apr. 9, 2002.
Response to Written Opinion under Article 34 submitted May 27, 2011 in PCT/US2010/043985.
International Application No. PCT/US2010/043985: International Search Report and Written Opinion dated Sep. 22, 2010.
Schlumberger, PowerDrive Xtra 475 Rotary Steerable System, SMP.5897.1_connect.slb.com, Dec. 2002, 2 pages.

(56) References Cited

OTHER PUBLICATIONS

Schlumberger, Statoil Saves Big with New Rotary Steerable System, Drilling Contractor, Mar.-Apr. 2004, p. 44.

* cited by examiner

DOWNHOLE DRILLING MOTOR WITH AN ADJUSTMENT ASSEMBLY

TECHNICAL FIELD

The present disclosure relates to a downhole motor configured to operate a drill bit to drill a well in an earthen formation, and in particular, to a downhole motor including one or more bends and an adjustment assembly that can facilitate directional control of the drill bit during drilling, as well related methods and drilling systems for drilling a well with such a downhole motor, and method of assembling such downhole motors.

BACKGROUND

Drilling systems are designed to drill into the earth to target hydrocarbon sources as efficiently as possible. Because of the significant financial investment required to reach and then extract hydrocarbons from the earth, drilling operators are under pressure to drill and reach the target as quickly as possible without compromising the safety of personal operating the drilling system. Typical drilling systems include a rig or derrick, a drill string supported by the rig, and a drill bit coupled to a downhole end of the drill string that is used to drill ther well into the earthen formation. Surface motors can apply torque to the drill string via a Kelly or top-drive thereby rotating the drill string and drill bit. Rotation of the drill string causes the drill bit to rotate thereby causing the drill bit to cut into the formation. Downhole or "mud motors" mounted in the drill string are used to rotate the drill bit independent from rotation of the drill string. Drilling fluid or "drilling mud" is pumped downhole through an internal passage of the drill string, through the downhole motor, out of the drill bit and is returned back to the surface through an annular passage defined between the drill string and well wall. Circulation of the drilling fluid removes cuttings from the well, cools the drill bit, and powers the downhole motors. Either or both the surface and the downhole motors can be used during drilling depending on the well plan. In any event, one measure of drilling efficiency is rate of penetration (ROP) (feet/hour) of the drill bit through the formation. The higher the ROP the less time is required to reach the target source. Because costs associated with drilling the well are pure expense to the drilling operator any decrease in the time needed to reach the target hydrocarbon source can potentially increase the return on investment required to extract hydrocarbons from that target source.

Directional drilling is a technique used to reach target hydrocarbons that are not vertically below the rig location. Typically the well begins vertically then deviates off of the vertical path at a kickoff point to turn toward the hydrocarbon source. Conventional techniques for causing slight deviations in the well include drill bit jetting and use of whipstocks. More prevalent directional drilling techniques, however, include steerable motors and rotary steerable systems. Steerable motors and rotary steerable systems are fundamentally different systems. Steerable motors use bent downhole motors to steer the rotating drill bit while the drill string slides, i.e. when the drill string does not rotate. As the drill bit rotates, the bent housing guides the drill bit in the direction of the bend. When the desired drilling direction is achieved, rotatory drilling resumes where the drill string and the drill bit rotate. Rotary steerable systems, in contrast, "push" or "point" the drill bit toward the predefined directions while the drill string and the drill bit rotate to define a turn in the well. Drillers will use steerable motors in lieu of other directional drilling techniques when higher build up rates (BURs) (degrees per 100 feet) are desirable. A higher BUR can effectuate a turn in a shorter distance and in a shorter period of time is therefore associated with a higher ROP through the turn. Lower build-up rates, indicative of more gradual turns and common to rotary steerable systems, may result in a lower ROP through the turn. But steerable motors are not without disadvantages. Using a steerable motor with a large bend during a rotary drilling mode can lead to failure of the downhole motor, the drill bit and other downhole tools. More severe bends increase the risk of failure. Lower bend angles decrease component failure risk but also decrease the build-up rate and can therefore decrease ROP.

SUMMARY

An embodiment of the present disclosure is a downhole motor configured to operate a drill bit to drill a well into an earthen formation. The downhole motor includes a motor housing having an uphole portion, one more bends, and a downhole portion that extends relative to bend away from the uphole portion in a downhole direction. The motor housing is configured to orient the drill bit in a direction that is offset with respect to the uphole portion of the motor housing when the downhole motor is coupled to the drill bit. The downhole motor includes a motor assembly including a stator supported by an inner surface of the motor housing and a rotor operably coupled to the stator. The rotor is configured to be operably coupled to the drill bit so as to cause rotation of the drill bit as a fluid passes through the motor housing. The downhole motor also includes an adjustment assembly supported by the motor housing and further including a contact surface. The adjustment assembly is configured to transition between a retracted configuration where the contact surface of the adjustment assembly is aligned a portion of the motor housing, and an extended configuration where the contact surface of the adjustment assembly extends outwardly away from the motor housing.

Another embodiment of the present disclosure is a method for controlling a drilling direction during a drilling operation that drills a well into an earthen formation. The method includes the step of rotating a drill string so as to drill the well into the earthen formation, the drill string including a downhole motor and a drill bit, the downhole motor includes one or more bends that offsets the drill bit respect to the drill string uphole relative to the one or more bends bend. The method includes causing rotation of the drill string in the well to stop. The method includes rotating the drill bit via the downhole motor disposed along the drill string while rotation of drill string in the well has stopped. The method includes actuating an adjustment assembly carried by the downhole motor such that a contact surface extends toward a wall of the well in a first direction so as to guide the drill bit along a second direction that is opposite to the first direction.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 1:
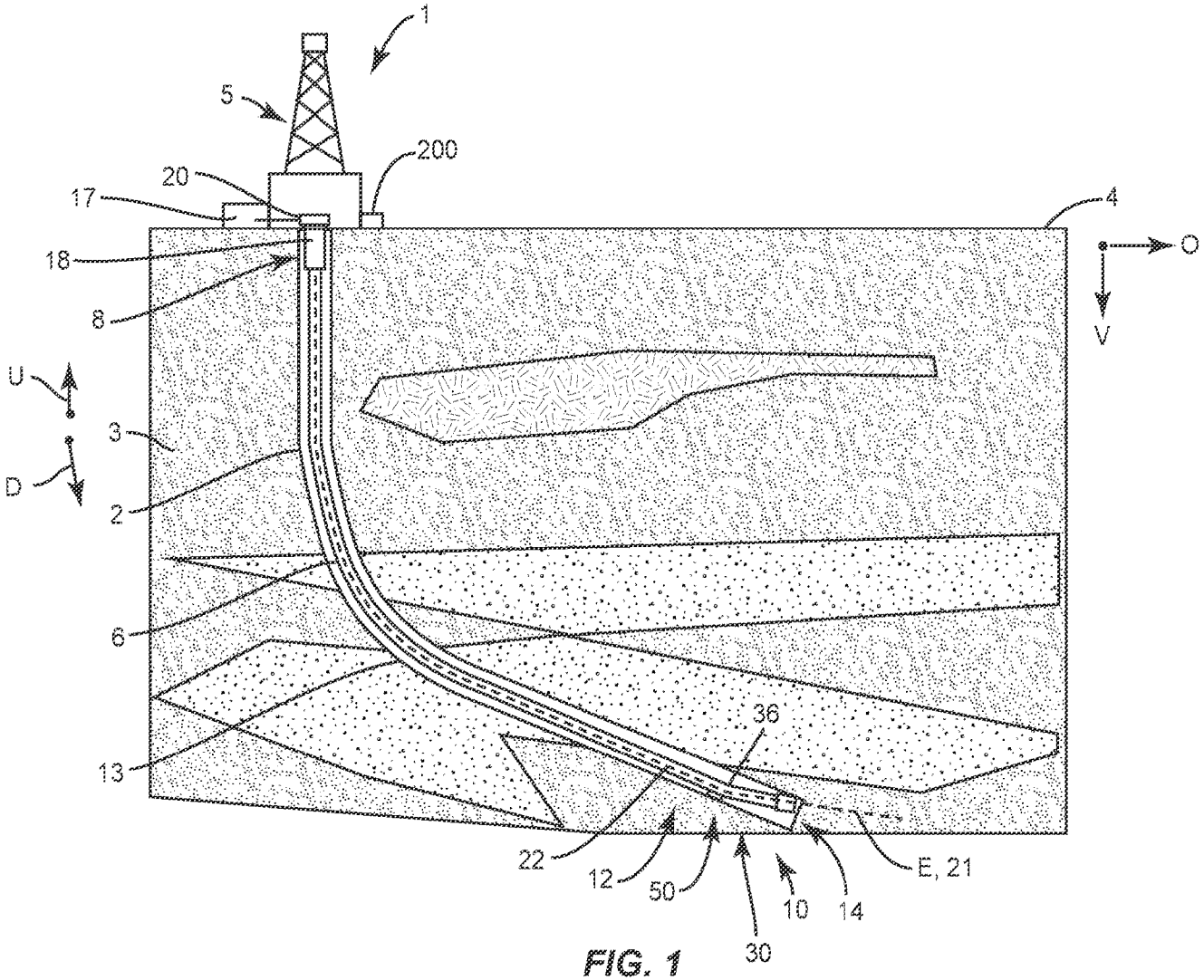
FIG. 1 is a schematic side view of a drilling system according to an embodiment of the present disclosure.

Referring to FIG. 1, embodiments of the present disclosure is a downhole motor 30 that includes one or more bends 36 and an adjustment assembly 36 that can selectively contact a wall of the well during drilling to help facilitate directional control of the drill bit, for instance to help achieve the desired build-up rate (BUR) during drilling. In this regard, the downhole motors are used herein may be referred to as steerable downhole motors, bent motors, or even steerable bent motors.

As can be seen in FIG. 1, the downhole motor 30 comprises part of a drilling system 1. The drilling system 1 includes a rig or derrick 5 that supports a drill string 6. The drill string 6 includes a bottomhole (BHA) assembly 12 coupled to a drill bit 14. The drill bit 14 is configured to drill a borehole or well 2 into the earthen formation 3 along a vertical direction V and an offset direction O that is offset from or deviated from the vertical direction V. The drilling system 1 can include a surface motor 20 located at the surface 4 that applies torque to the drill string 6 via a rotary table or top drive (not shown), and the downhole motor 30 disposed along the drill string 6 and is operably coupled to the drill bit 14. The drilling system 1 is configured to operate the in a rotary steering mode where the drill string 6 and the drill bit 14 rotate, and (preferably) a sliding mode where the drill string 6 does not rotate but the drill bit does. Operation of the downhole motor 30 causes the drill bit 14 to rotate along with or without rotation of the drill string 6. Accordingly, both the surface motor 20 and the downhole motor 30 can operate during the drilling operation to define the well 2. During the drilling operation, a pump 17 pumps drilling fluid 9 (shown in FIG. 3) downhole through an internal passage 7 of the drill string 6 out of the drill bit 14 and is returned back to the surface 4 through an annular passage 13 defined between the drill string 6 and well wall 11. Operation of the downhole motor 30 will be described below.

Figure 7:
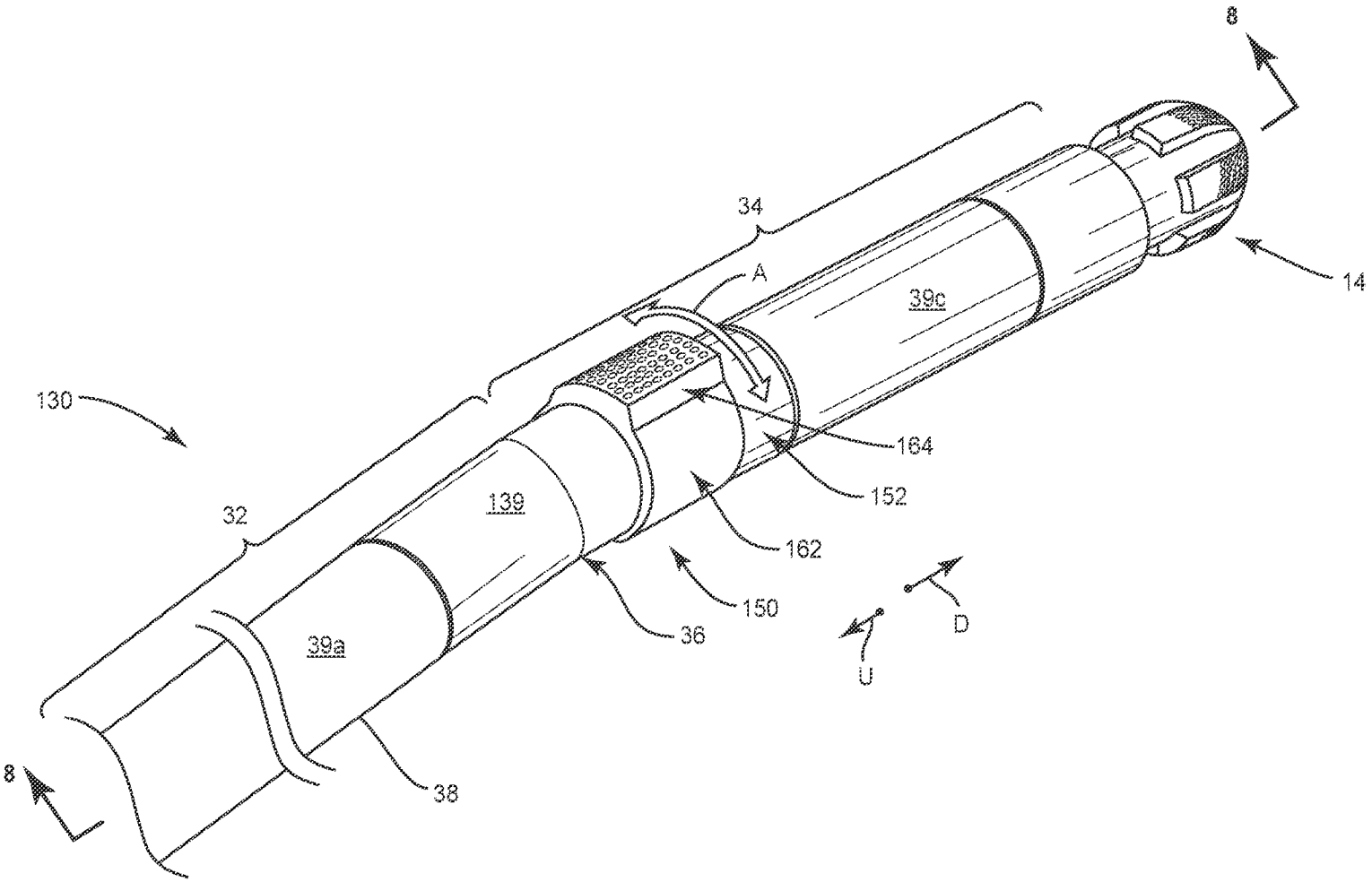
FIG. 7 is a perspective view of a downhole motor with an adjustment assembly in the drilling system shown in FIG. 1, in accordance with another embodiment of the present disclosure.

Continuing with FIG. 1, in accordance with an embodiment of the present disclosure, the downhole motor 30 is provided with one or more bends or bend 36 and an adjustment assembly 50 (see also reference 150 in FIG. 7). The adjustment assembly 50 is configured to selectively apply a force against the well wall 11 in a direction that is opposite the direction of the bend 36. The result likely is a side force applied to the drill bit 14 that causes the drill bit 14 to drill in the direction of the bend 36 orients the drill bit. Application of the force against the well wall 11 in the manner further detailed below can result in a desirable (usually higher) BUR even when the bend 36 defines relatively low bend angle. The result is an optimized BUR without the associated risks of utilizing a bend with larger bend angles during the rotary drilling mode (when the drill string rotates).

The drill string 6 is elongate along a longitudinal central axis 26 that is aligned with a well axis E and further includes an uphole end 8 and a downhole end 10 spaced from the uphole end 8 along the longitudinal central axis 26. A downhole direction D refers to a direction from the surface 4 toward the downhole end 10 of the drill string 6. Uphole direction U is opposite to the downhole direction D. Thus, "downhole" refers to a location that is closer to the drill string downhole end 10 than the surface 4, relative to a point of reference. "Uphole" refers to a location that is closer to the surface 4 than the drill sting downhole end 10, relative to a point of reference.

Figure 12:
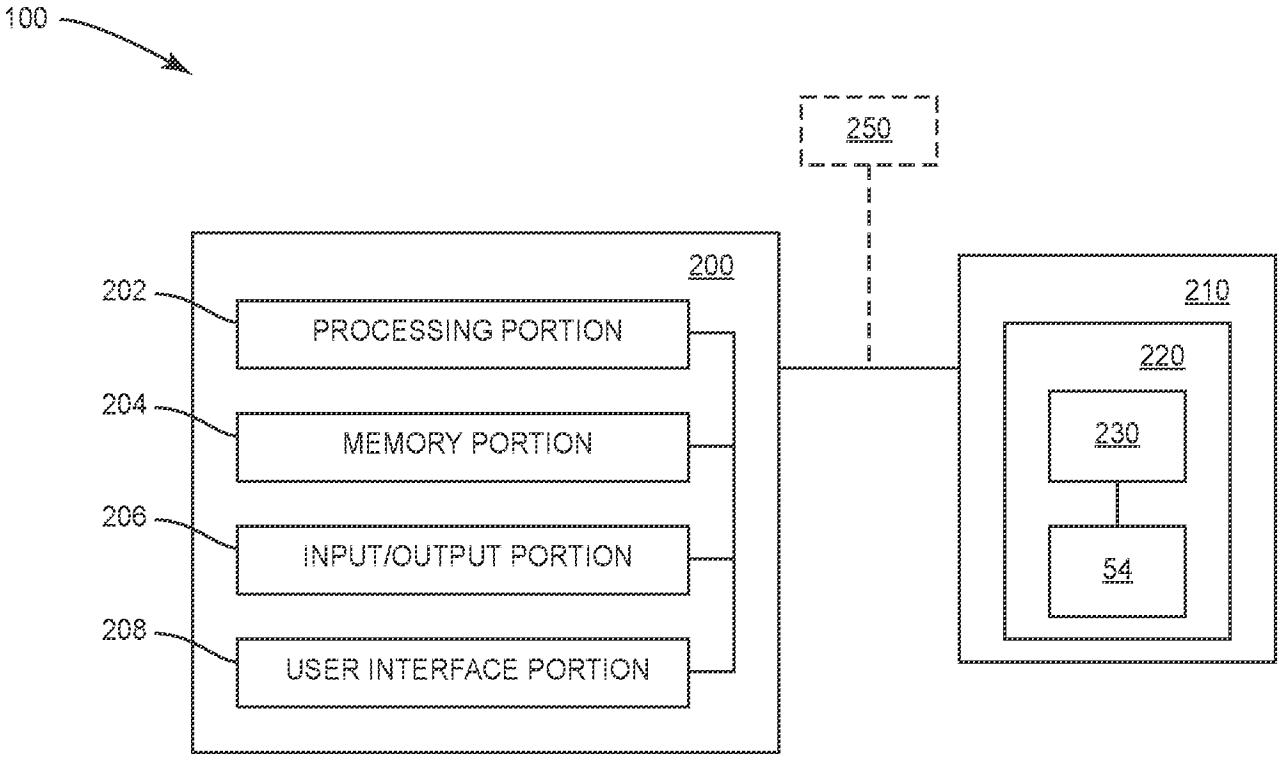
FIG. 12 is a schematic of a control system used to actuate the adjustment assembly of the downhole motor between the retracted and extended configuration.

Continuing with FIGS. 1 and 12, the drilling system 1 can include a control system 100, a telemetry system 250 (FIG. 12), and a measurement-while-drilling (MWD) tool 22 disposed downhole for obtaining drilling data, such as inclination and azimuth. The control system 100 can include a surface control system in the form of one or more computing devices 200 and a downhole control system 210 (FIG. 12). Details concerning the control system 100 will be described below. In addition to components discussed above, the drilling system 1 includes a casing 18 that extends from the surface 4 and into the well 2. The one or more such casings 18 can be used stabilize the formation near the surface. One or more blowout preventers can be disposed at the surface 4 at or near the casing 18.

The telemetry system 250 facilitates communication among the surface control system components 200 and downhole control system 210 for instance components of the MWD tool 22 and downhole motor 30 as further described below. The telemetry system 250 can be a mud-pulse telemetry system, an electromagnetic (EM) telemetry system, an acoustic telemetry system, a wired-pipe telemetry system, or any other communication system suitable for transmitting information between the surface and downhole locations. Exemplary telemetry systems can include a transmitters, receivers, and/or transceivers, along with encoders, decoders, and controllers.

Continuing with FIG. 1, the MWD tool 22 can be attached to or suspended within the drill string 6 at a location up-hole relative to the downhole motor 30. The MWD tool 22 can include a power source, transmitter (or transceiver) for communication with the telemetry system, a short-hop transceiver in communication with other electronic components of the bottom hole assembly 12, such as the downhole motor 30, and a controller including a processor and memory. The MWD tool 22 is configured to obtain drilling information indicative of the drilling direction of the drill bit 14 (or other components of the bottom hole assembly 12) and includes a plurality of sensors for this purpose. In accordance with one embodiment, the sensors obtain direct measurements of the azimuth and inclination of the drill bit 14. For instance, the MWD tool may include three magnetometers for measuring azimuth about three orthogonal axes, and three accelerometers for measuring inclination about the three orthogonal axes. Alternatively, the plurality of sensors obtains information that can be used to determine azimuth, inclination and tool face angle of a drill bit 14. For example, the MWD processor is configured to, in response to receiving measurements obtained from the magnetometers and the accelerometers, determine the tool face angle—the angular orientation of a fixed reference point on the circumference of the drill string 6 in relation to a reference point on the bore 2. While the MWD processor can be configured to determine tool face angle of the drill bit 14, processors housed elsewhere can be configured to determine drilling direction information based on inputs from the MWD sensors. Drilling direction information as used in this disclosure can include one or any combination of azimuth, inclination, and tool face angle. Drilling direction information obtained during a drilling operation can be used to control operation of the adjustment assembly 50 in order to guide the drill bit 14 in accordance with the well plan. While MWD tool 22 is illustrated, a logging-while-drilling (LWD) tool may be used in combination with or in lieu of the MWD tool 22.

Figure 2:
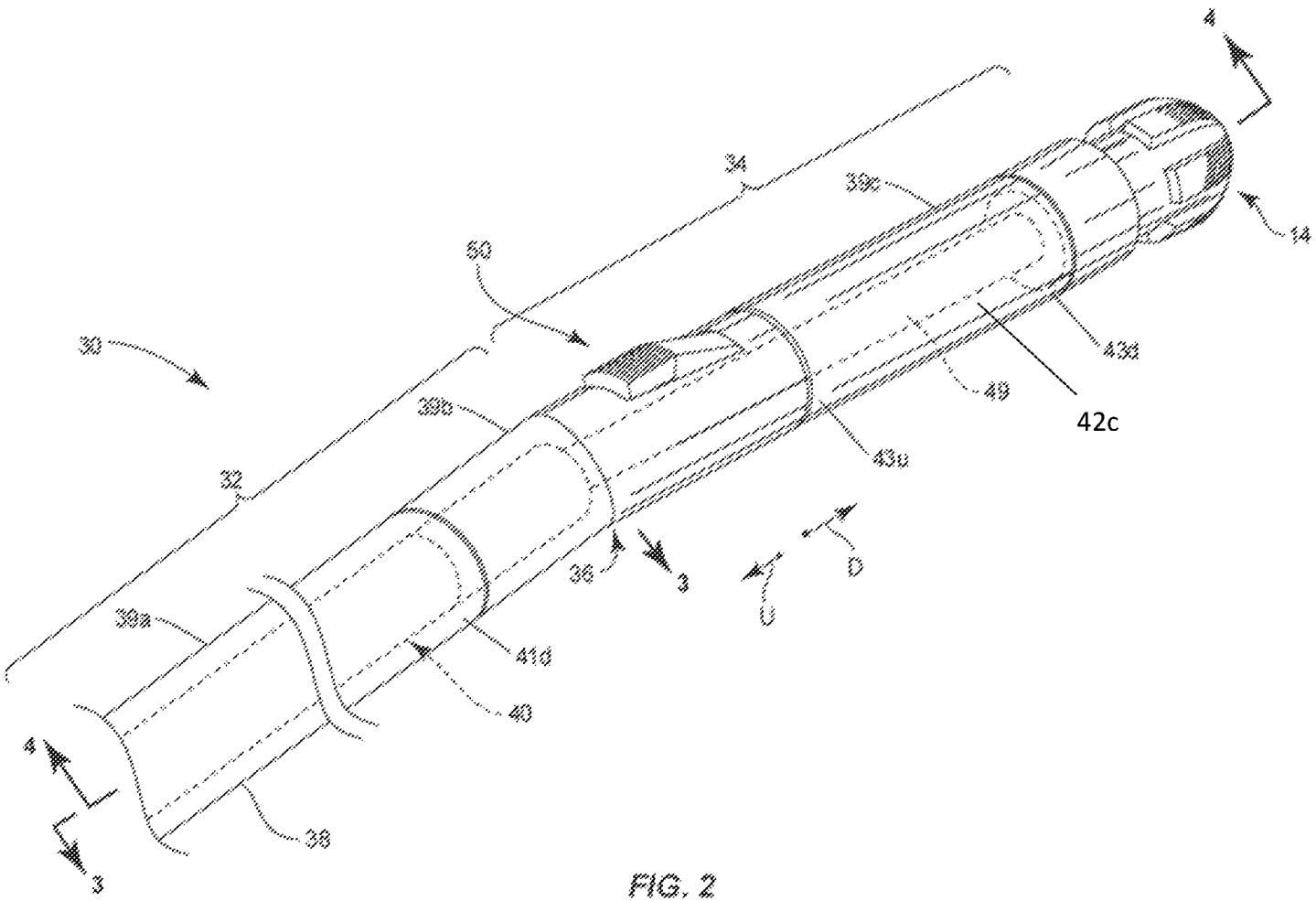
FIG. 2 is a perspective view of a downhole motor with an adjustment assembly in the drilling system shown in FIG. 1.
Figure 3:
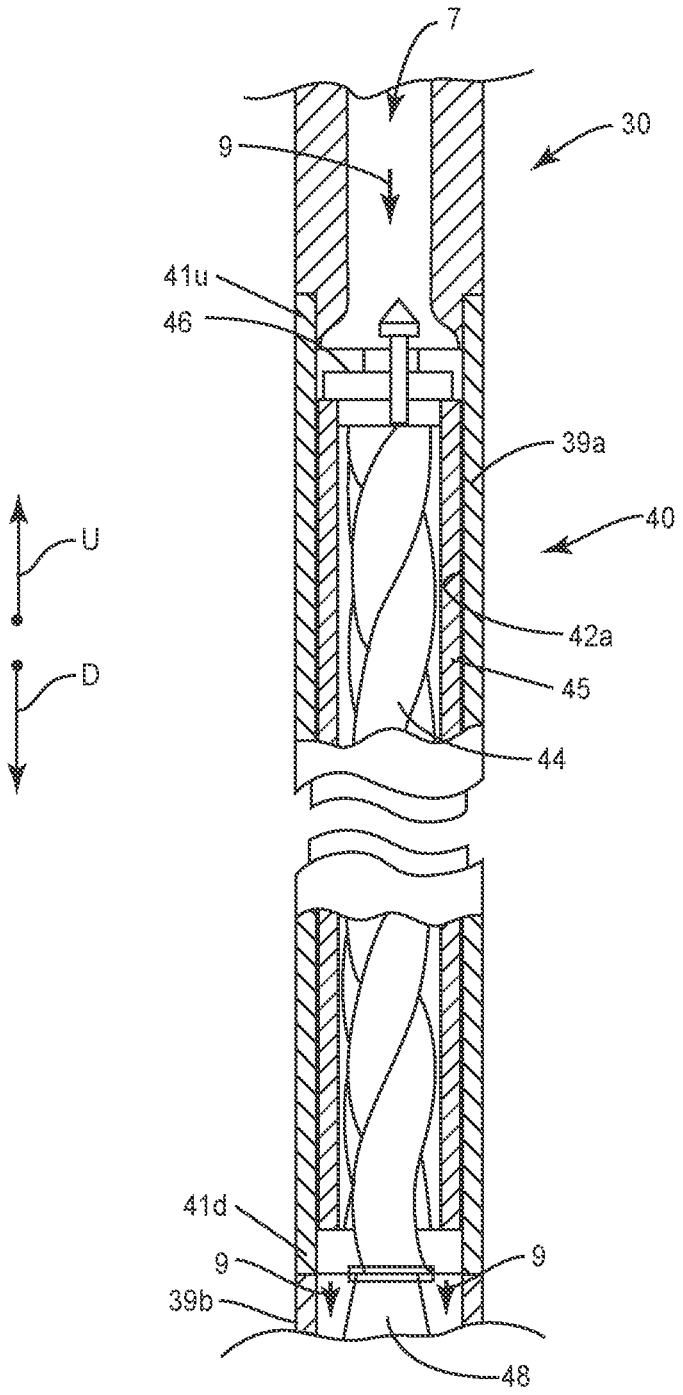
FIG. 3 is a cross-sectional view of the downhole motor taken along lines 3-3 in FIG. 2.

Turning now to FIGS. 2 and 3, the downhole motor 30 can include a motor housing 38, a motor assembly 40 contained in and supported by the motor housing 38, and the adjustment assembly 50. The drill bit 14 can be operably coupled to the motor assembly 40 and driven by operation of drilling fluid through the motor housing 38 as further detailed below. The downhole motor 30 (or downhole motor 130 shown in FIG. 7) can include one or more optional stabilizers that help position the motor 30 toward the center of the well 2. The stabilizers are not shown in the figures. In one example, the downhole motor 30 can include an uphole stabilizer disposed uphole relative to the bent housing component 39*b*. Further, the downhole motor 30 can include a near-bit stabilizer located just uphole from the drill bit 14.

Figure 4:
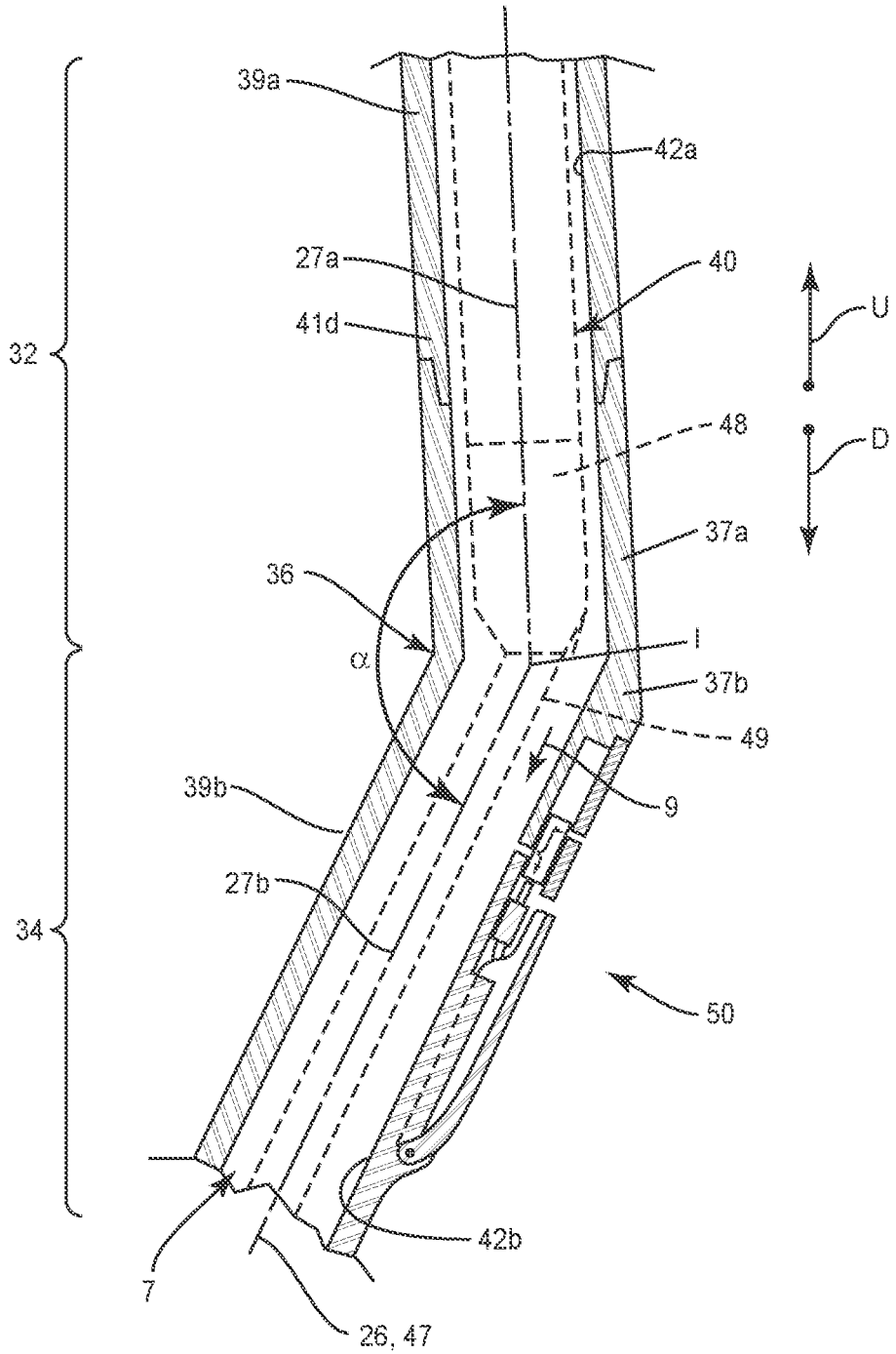
FIG. 4 is a cross-sectional view of the downhole motor taken along lines 4-4 in FIG. 2.
Figure 5A:
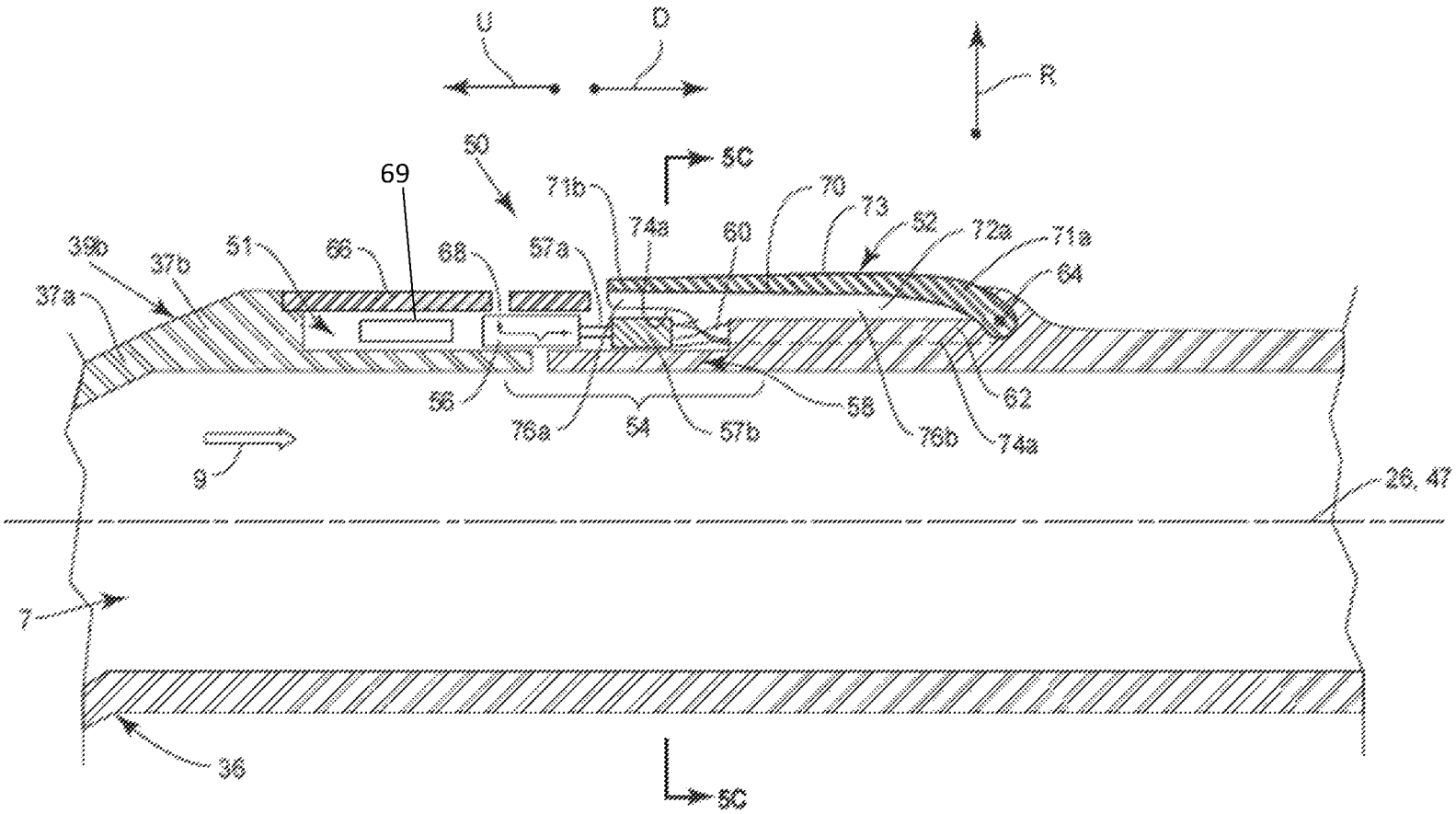
FIG. 5A is a detailed cross-sectional view of a portion of the downhole motor illustrated in FIG. 4.
Figure 5B:
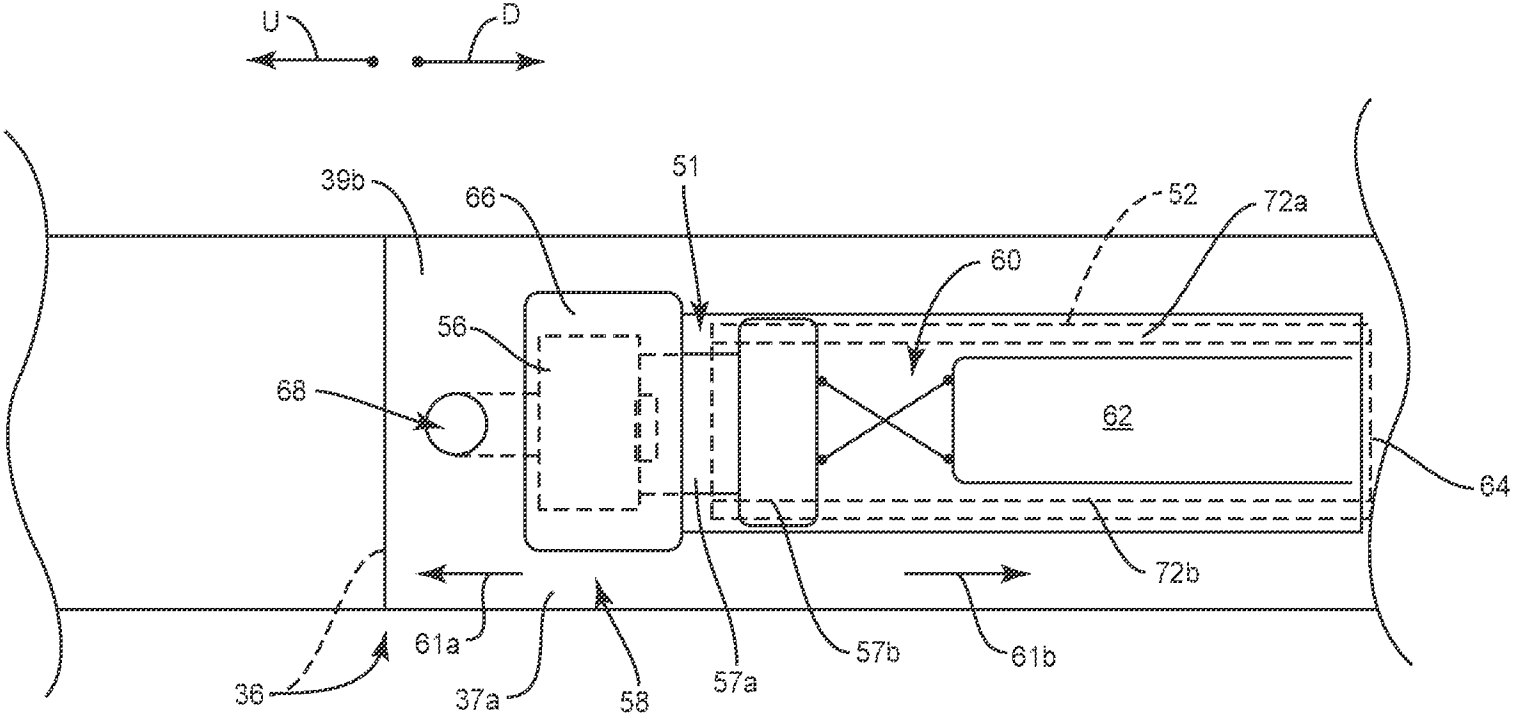
FIG. 5B is a plan view of a portion of downhole motor illustrated in FIG. 2; with a moveable member removed for clarity.
Figure 5C:
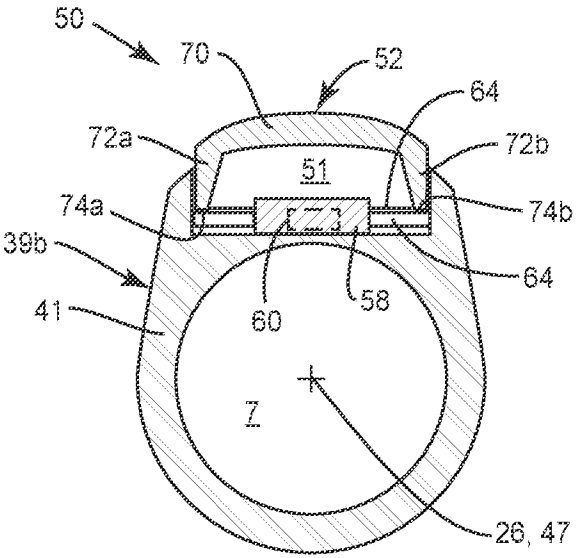
FIG. 5C is a cross-sectional view the downhole motor taken along lines 5C-5C in FIG. 2.

Referring to FIGS. 2 and 5, the motor housing 38 includes a bend 36 that is selected to orient the drill bit 14 in an offset direction. The motor housing 38 can be referred to as a bent motor housing 38. As illustrated, the motor housing 38 includes an uphole portion 32 and a downhole portion 34 disposed relative the uphole portion 32 along the downhole direction D. The uphole and downhole portions 32 and 34 meet at the bend 36. Furthermore, the motor housing 38 includes an uphole or first housing component 39*a*, an intermediate or second housing component 39*b*, and a downhole or third housing component 39*c*. The uphole or first housing component 39*a* can have a first or uphole end 41*u* and a second or downhole end 41*d* spaced from the uphole end 41*u* along the downhole direction D. The uphole end 41*u* of the housing component 39*a* is threadably connected to a housing component such as a drill pipe or a drill collar. The intermediate or second housing component 39*b*, sometimes referred to as a bent housing component, defines the bend 36. As illustrated, the second housing component 39*b* can carry or support the adjustment assembly 50. The intermediate housing component 39*b* can define a housing body 37*a* with a rib 37*b*. The housing body 37*a* defines a cavity 51 (FIG. 5A, 5C) that contains at least a portion of the adjustment assembly 50. A hatch covers 66 can cover and seal a portion of the cavity 51. The downhole or third housing component 39*c* includes opposed uphole and downhole ends 43*u* and 43*d* spaced apart along the downhole direction D. Each housing component 39*a*, 39*b* and 39*c* define respective inner surfaces 42*a*, 42*b*, and 42*c* (42*a* and 42*b* shown in FIG. 4), and opposing respective outer surfaces (not numbered) that face the well wall 11. The inner surface 42*a*, 42*b*, and 42*c* define a portion of the internal passage 7 that extends through the entirety of the drill sting 6. While three housing components are shown, more or few housing components can be used to define the drilling motor housing 38.

As illustrated in FIG. 4, the housing 38 can define a particular bend angle in order to attain a desired build up rate (BUR). The housing uphole portion 32 can extend along an uphole or first axis 27*a* and the downhole portion 34 can extend from the bend 36 along a downhole or second axis 27*b*. The first and second axes 27*a* and 27*b* can intersect at a point I that is disposed along the longitudinal central axis 47 of the downhole motor 30. The first and second axes 27*a* and 27*b* can be considered components of the longitudinal central axis 47 and are coincident with the longitudinal central axis 26. The bend 36 includes an angle $\alpha$ defined by the uphole axis 27*a* and the downhole axis 27*b*. It should be appreciated that the bend angle $\alpha$ can vary based on the particular use and need of the well. The bend angle $\alpha$ can be between some value greater than 0 degrees and up to about 5 degrees. In one embodiment, the bend angle can be between about 0.10 degrees to about 5.0 degrees. In one embodiment, the bend angle can be between about 0.10 degrees to about 5.0 degrees. In one embodiment, the bend angle can be between about 0.10 degrees to about 4.5 degrees. In one embodiment, the bend angle can be between about 0.10 degrees to about 4.0 degrees. In one embodiment, the bend angle can be between about 0.10 degrees to about 3.5 degrees. In one embodiment, the bend angle can be between about 0.10 degrees to about 3.0 degrees. In one embodiment, the bend angle can be between about 0.10 degrees to about 2.5 degrees. In one embodiment, the bend angle can be between about 0.10 degrees to about 2.0 degrees. In one embodiment, the bend angle can be between about 0.10 degrees to about 1.5 degrees. In one embodiment, the bend angle can be between about 0.10 degrees to about 1.0 degrees. In one embodiment, the bend angle can be between about 0.10 degrees and 0.75 degrees. In another embodiment, the bend angle can be between about 0.10 degrees and 0.50 degrees. In another embodiment, the bend angle can be between up to about 0.10 degrees. The other embodiments, the bend angle can be about 0.10 degrees, about 0.2 degrees, about 0.50 degrees, about 0.75, about 1.0 degrees, about 1.5 degrees, about 2.0 degrees, about 2.50 degrees, about 3.0 degrees, about 3.5 degrees, about 4.0 degrees, about 4.50 degrees, or about 5.0 degrees. The bend angle is not limited to the aforementioned values and ranges.

Any portion of the downhole motor can include the bend 36. For example, the downhole motor 30 may not include a bend 36 located or defined by the intermediate housing component 39*b* as illustrated in FIGS. 2 and 4. Rather, the bend 36 could be defined at any portion of the housing 38.

In other configurations, the bend 36 can be defined by a sub connected between the drill bit 14 and the housing 38. In another example, the bend 36 can be connected uphole to the motor housing 38. For instance, a bent sub can be used to couple the drill bit 14 to the housing 38 in order to orient the drill bit 14 at an angle relative to at least an uphole portion of the downhole motor 30. In addition, the motor housing can include more than one specifically defined bend. For instance, a housing can include several bends that collective orient the drill bit 14 in a direction that is offset with respect to an uphole portion the downhole motor 30.

Referring back to FIG. 3, the motor assembly 40 is disposed inside the internal passage 7 of the housing component 39*a*. The motor assembly 40 includes a stator 45 mounted to the inner surface 42*a*, a rotor 44 rotatably disposed within an internal cavity of the stator 45, and a shaft assembly 49 coupled to the rotor 44 by a flexible coupling 48. The stator 45 typically includes a cavity with a number of channels, e.g. 4 channels arranged in a helical pattern (channels not shown). The stator 45 defines an inner cross-sectional shape. The rotor 44 includes multiple lobes, but generally a fewer of number lobes, e.g. 3 lobes, compared to the number of channels defined in the stator 45. The different number in lobes in rotor compared to the number of channels in the stator cause the rotor 44 to rotate eccentrically in the stator cavity. Further, the difference between the inner cross-section of rotor 44 and outer cross-sectional shape of the stator 45 define internal passages in motor assembly 40 that vary with rotation position of the stator 45 relative to the rotor 44 and allow the drilling fluid to pass through the motor assembly 40. The rotor 44 is supported uphole indirectly by the housing component 39*a* with a support 46. The support 46 is configured to hold the rotor 44 and also permit drilling fluid 9 to pass therethrough into the spaces defined between the stator 45 and rotor 44. The shaft assembly 49 is operably connected to the drill bit 14 at the bit box (not numbered) such that drill bit 14 rotates along with rotation of the shaft assembly 49. In operation, the pump 17 at the surface 4 pumps the drilling fluid 9 downward through the internal passage 7 in the drill string 6 into the motor assembly 40. The drilling fluid 9 passes into the spaces defined between the rotor 44 and stator 45 and impinges the rotor 44 and driving eccentric rotation of the rotor 44 relative to the stator 45. Rotation of the rotor 44 rotates the shaft assembly 49 which rotates the drill bit 14. As illustrated, the flexible coupling 48 transmits the eccentric rotation of the rotor 44 to the shaft assembly 49. In an embodiment, the flexible coupling 48 is a universal joint and bearing assembly which allows the shaft assembly 49 to rotate despite the eccentric rotation of the rotor 44 and the angular offset created by the bent housing component 39*b*.

Figure 6B:
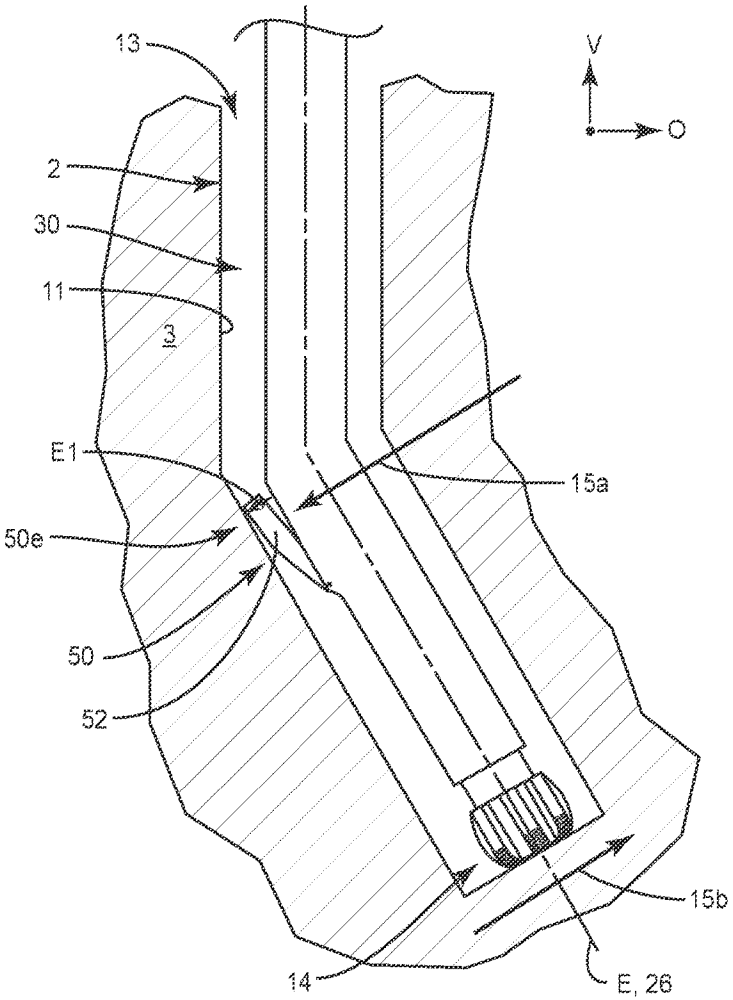
FIGS. 6A and 6B illustrate the downhole motor in shown FIG. 2 with an adjustment assembly in a retracted configuration and an extended configuration, respectively.
Figure 6A:
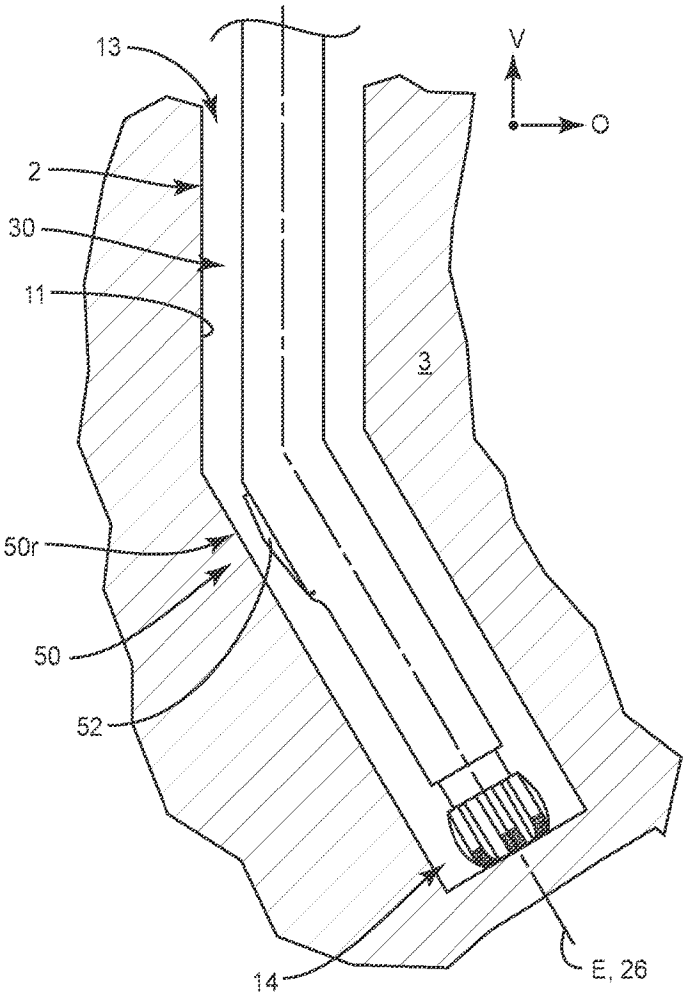

Turning now to FIGS. 2, 6A and 6B, the adjustment assembly 50 and bend 36 in the motor 30 can help the drilling operator obtain and maintain a desirable BUR during drilling. When the adjustment assembly 50 is utilized with a moderate or even a slight bend, the resultant theoretical BUR can be increased. See for example FIG. 13 and the discussion regarding FIG. 13 found below. As illustrated, the adjustment assembly 50 is located proximate the bend 36. For example, the adjustment assembly 50 can be aligned with the bend 36 along a direction transverse to the axis longitudinal central axis 47, or spaced slightly uphole or downhole relative the bend 36. In alternative embodiments, the adjustment assembly 50 can be spaced downhole relative to the bend 36 or spaced uphole relative the bend. For example, the bend 36 can defined by one housing component and the adjustment assembly 50 can be carried by a different housing component. In such an embodiment, for example, the intermediate housing 39*b* may not have a bend but would include an adjustment assembly 50 (or 150 shown in FIG. 7).

The adjustment assembly 50 includes a moveable member 52 that is used to guide direction the drill bit 14 while drilling a turn in the well. As illustrated in FIGS. 2-6B, the moveable member 52 can be configured as an arm or pad. In the embodiments illustrated in FIGS. 7-11B, the moveable member is an engagement pad disposed on a rotatable shaft.

Continuing with FIG. 2, 6A and 6B, the adjustment assembly 50 is configured to transition the moveable member 52 between an extended configuration 50*e* as shown in FIG. 6B and the retracted configuration 50*r* as shown in FIGS. 2 and 6A. When the adjustment assembly 50 in the extended configuration 50*e*, a portion of the moveable member 52 projects outwardly away from the central axis 26 along a radial direction R that is perpendicular to the central axes 26 and 47. In the extended configuration, a free end 71*b* (FIG. 5A) of the moveable member 52 (or arm) extends an extension distance E1 from an outer surface (not shown) of the downhole motor 30 to apply a force F to wall 11 in a first direction 15*a*, which results in a side force applied to the drill bit 14 along a second direction 15*b* that is aligned with the direction of the bend 36. When the adjustment assembly 50 is in the retracted configuration 50*r*, the moveable member 52 is disposed more toward the central axis 26 as shown in FIG. 6A and is generally aligned with the outer surface (not numbered) of the downhole motor 30. In the retracted configuration 50*r*, the free end 71*b* (FIG. 5A) of the moveable member 52 is aligned with the outer surface of the downhole motor 30. In addition, when moveable member 52 is in the retracted configuration 50*r*, typically the uphole stabilizer (not shown) the bend 36 apply forces to the well wall 11 and to cause a directional change in the drill bit 14. However, when the adjustment assembly 50 is activated and the moveable member 52 is extended, the BUR can increase compared to when the adjustment assembly 50 is in the retracted configuration 50*r* so that the moveable member 52 is not extended toward the well wall 11. The result is possible higher BUR with lower than expected bend angles in the downhole motor 30.

Turning now to FIGS. 5A through 5C, the adjustment assembly 50 is includes on or more actuators 54 that control movement or activation of the moveable member 52. The actuator 54 can be operably connected with a controller 220 (FIG. 12). The controller 220 is configured operate the actuator 54 so as to selectively cause the moveable member 52 to transition between the retracted configuration and the extended configuration. The controller 220 forms part of the downhole control system 210 as will be further described below. The actuator 54 is disposed in the housing cavity 51. The controller 220 can be contained on a board 69 with other circuitry. The board 69 is shown contained in the cavity 51, but the board 69 can be isolated from the cavity 51 and the actuator 54.

In accordance with the illustrated embodiment, the moveable member 52 is an arm or pad configured to pivot relative to the housing 38 about a pivot location 64. The moveable member 52 or arm defines a body 70 having a first end or base end 71*a* and a second or free end 71*b* opposed to the base end 71*a*. The body 70 has an outer surface 73 that faces the wall of the well. The outer surface 73 can be referred to as contact surface that can engage the wall 11 the well when the moveable member 52 is extended. The base end 71*a* is coupled to the housing 38 by a pin 64 which also defines the pivot location. The arm 52 includes a first portion 76*a* aligned with the free end 71*b* and a second portion 76*b* disposed toward the base end 71*a*. The first and second portions 76*a* and 76*b* are configured to engage a portion of portion of the actuator 54 to cause the moveable member 52 to pivot about the pivot location 64 in response to the pressure of the drilling fluid. The body 70 defines opposed sidewalls 72*a* and 72*b* spaced apart to define an internal space sized to receive an abutment 62 (see dotted lines portion in FIG. 5B) and a portion of the actuator 54. Each side wall defines arcuate edges 74*a* and 74*b* that extend along the sidewalls 72*a* and 72*b* from the free end 71*b* toward base end 71*a*. The first portion 76*a* of the moveable member 52 can define a first dimension (not shown) that extends from the edges 74*a* and 74*b* to the housing body 37*a* at a location aligned with the free end 71*b* of the body 70. The second portion 76*b* defines a second dimension (not shown) extends from the edges 74*a* and 74*b* to the housing body 37*a* at a location disposed toward the base end 71*a* and aligned with the abutment 62 of the housing body 37*a*. The second dimension is less than the first dimension such that the first portion 76*a* is elevated above the housing body 37*a*. In other words, the side walls 72*a* and 72*b* have a smaller wall height along the first portion 76*a* compared to the height of the walls 72*a* and 72*b* along the second portion 76*b*. Accordingly, the moveable member 52 can define an engagement surface (not numbered) disposed on the edges 74*a* and 74*b* that extends along the first and second portions 76*a* and 76*b*. The engagement surface can abut a portion of the actuator 54 as further detailed below.

Continuing with FIGS. 5A and 5B, the actuator 54 can be a fluid operated system that causes the moveable member 52 to pivot about the pivot connection 64 as needed to direct a force against the well wall 11. The actuator 54 includes a valve 56, an engagement member 58 configured to move relative to valve 56, a biasing member 60 disposed between the engagement member 58 and the abutment 62. The valve 56 is electronically connected to the controller 220. The valve 56 includes at least one chamber (not numbered) that is in flow communication with the internal passage 7 such that drilling fluid can be directed into the chamber. The valve 56 is configured to, in response to inputs from the controller 220, selectively direct drilling fluid from the chamber toward the engagement member 58 or out of the release port 68. The engagement member 58 includes a rod 57*a* operably and moveably coupled to the valve 56 and an engagement head 57*b* attached to the rod 57*a*. The biasing member 60, which can be a compression spring, applies a force against the engagement head 57*b* urging the engagement head 57*b* in a first direction 61*a* toward the valve 56 when the adjustment assembly 50 is in the retracted configuration. With engagement head 57*b* biased in a retracted position toward the valve 56, the moveable member 52 rests at least partially within the cavity 51. As illustrated, the opposed side walls 72*a* and 72*b* disposed adjacent the abutment 62 and the free end 71*b* of the moveable member 52 is generally aligned with the outer surface of the downhole motor 30 (see FIG. 5A). Another biasing member (not shown) disposed in housing body 37*a* and extends to the moveable member 52 over the pin 64 biases the moveable member 52 into the retracted position. For instance, a leaf spring can be coupled to housing body 37*a* and the moveable member 52 to bias the moveable member 52 into the retracted position.

Continuing with FIGS. 5A and 5B, in operation, drilling fluid 9 enters the chamber in the valve 56. The controller 220 causes the valve 56 to direct drilling fluid from the chamber to impinge a distal end of the engagement member 58. For instance, the drilling fluid 9 can impinge a distal end of the rod 57*a*. Pressure of the drilling fluid directed against the rod 57*a* causes the engagement head 57*b* move in the second or actuation direction 61*b* toward the abutment 62, thereby compressing the biasing member 60 against the abutment 62. As the engagement member 58 moves in the actuation direction 61*b*, the engagement head 57*b* moves from a region in the cavity 51 aligned with the first portion 76*a* of the moveable member 52 toward the second portion 76*b* of the moveable member 52. More specifically, the engagement head 57*b* rides along the arcuate edges 74*a* and 74 of the moveable member 52 toward the pivot location 64. Further movement of engagement head 57*b* along the edges 74*a*, 74*b* toward the abutment 62 cause the moveable member 52 to pivot outwardly into the extended configuration as shown in FIG. 6B. When controller 220 directs the valve 56 to stop flow communication with the engagement member 58, the biasing member 60 urges the engagement head 57*b* back to its initial position. The edges 74*a* and 74*b* of the moveable member 52 ride along the engagement head 57*b* until the engagement head 57*b* is disposed entirely in region aligned with first portion 76*a* of the moveable member 52. At this point, engagement member is in a retracted or normal position and the moveable member 52 is the retracted configuration as shown in FIG. 6A. In alternative embodiments, the actuator can be hydraulic pump configured to actuate the moveable member 52. For instance, the actuator can include the valve 56 operably connected to pump (not shown). The pump can supply a fluid to the valve 56 under pressure. The valve 56 can selectively permit the pressurized fluid to impinge the engagement member 58 to cause the engagement member 58 to move relative to the moveable member 52 as described above.

The moveable member or arm 52 as shown in FIGS. 5A-5C and described above includes sidewalls 72*a* and 72*b* and arcuate edges 74*a* and 74*b*. In other embodiments, the moveable member 52 can be a flat rod, a plate, cylinder, or tube is coupled to the housing body 37*a*. According, the movement member 52 may define any type of engagement surface configured to engage the actuator 54. In addition, in still other alternative embodiments, the moveable member 52 can be configured as an arm or piston that translates along the radial direction R that is perpendicular to the central axis 26 in lieu of arm that that pivots in order to move from the retracted configuration into the extended configuration.

Turning now to FIGS. 7-11B, a downhole motor 130 in accordance with another embodiment of the present disclosure includes one or more bends 36 and an adjustment assembly 150. The downhole motor 140 is constructed in some respects similar to the downhole motor 30 illustrated in FIGS. 2 through 6B and discussed above. Accordingly, similar reference numbers will be used to refer to components that are common between the downhole motor 30 describe above and shown in FIGS. 2-6B and the downhole motor 130 described below and shown in FIGS. 7-11B. The downhole motor 130 has an uphole portion 32, a downhole portion 34, and or more bends or bend 36 that can define a bend angle $\alpha$. The downhole motor 150 can also include multiple housing components, such as a first or uphole housing component 39*a*, an intermediate or bent housing component 139, and a second or downhole housing component 39*c*. As illustrated, the adjustment assembly 150 is fixed to the intermediate or bent housing component 139 and also fixed to the downhole component 39*b* so that the adjustment assembly 150 is positioned proximate yet downhole from the bend 36. It should be appreciated that the adjustment assembly 150 can be positioned uphole relative to the bend 36 as well. For instance, the adjustment assembly 150 can be fixed to the intermediate or bent housing component 139 and fixed to the uphole component 39*a* so that the adjustment assembly 150 is positioned proximate yet uphole from the bend 36. In this regard, the adjustment assembly 150 is carried by or supported by the motor housing.

Figure 8:
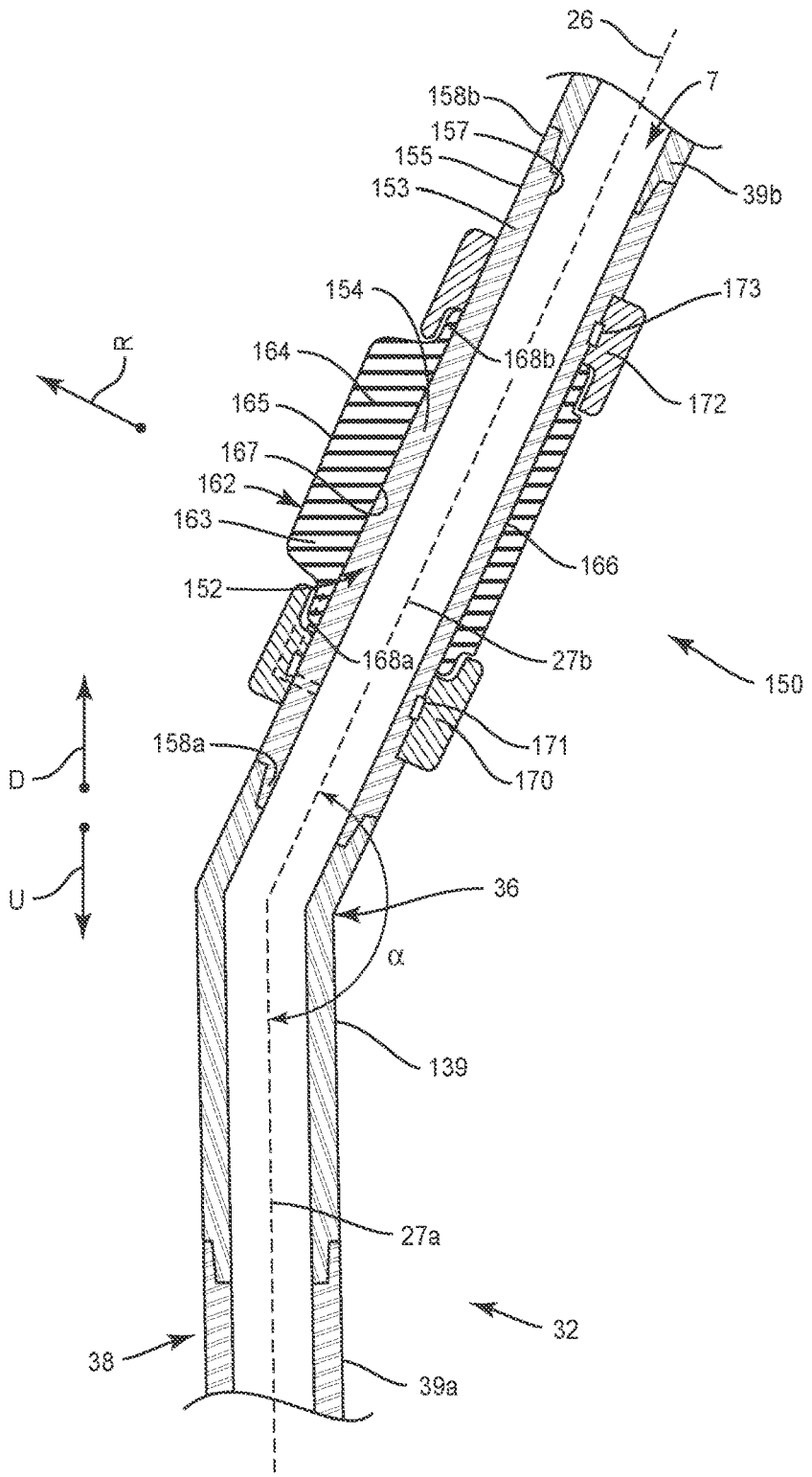
FIG. 8 is a cross-sectional view of the downhole motor taken along lines 8-8 in FIG. 2.

As shown in FIG. 7 and described above, the downhole motor 150 includes an adjustment assembly 150 configured to selective engage the well wall 11 during drilling. As illustrated, the adjustment assembly 150 includes a first component or inner component 152, a second or outer component disposed around and moveable relative to the inner component 152, and a moveable member 164 carried by the outer component 162. The outer component 162 carries the moveable member 164 and can rotate around the inner eccentric component 152 in a rotational direction A in order to selectively apply the force the well wall 11. The moveable member 164 includes an outer or contact surface 165 that can engage the well wall 11 based on the rotational position of the outer component 162 relative to the inner component 152, as will be further described below. Furthermore, the outer and inner components 162 and 152 can include eccentric portions. In this disclosure, the first component 152 can be referred to as the first or inner eccentric component 152 and the second component 162 can be referred to the second or outer eccentric component 162. In addition, the outer eccentric component 162 is sometimes referred to as a moveable component while the inner eccentric component is sometimes referred to as a fixed component. However it should be appreciated that either the first component 152 and the second component 162 can move relative to the other component. Alternatively, both the first and second components can be moved relative to each other. And as illustrated, the inner eccentric component 152 is threadably coupled to the bent housing 139 and the uphole housing 39*c*. In this regard, the inner eccentric component may be referred to as a housing component. In addition, the adjustment assembly 150 can also include one or more attachment members 170 and 172 that rotatably couple the outer component 162 to the inner component 152 (FIG. 8). In FIG. 7, the attachment members 170 and 172 are removed to better illustrate the outer and inner components 162 and 152.

Figure 11B:
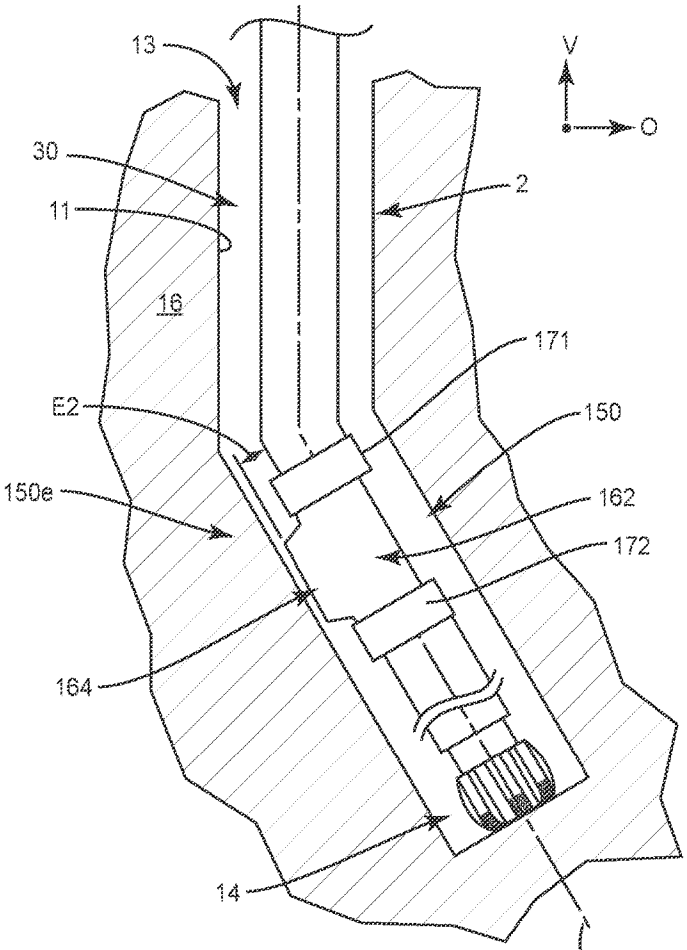
FIGS. 11A and 11B illustrate the downhole motor in shown in FIG. 7, with the adjustment assembly in a retracted configuration and an extended configuration, respectively.

The adjustment assembly 150 also includes an actuator (not shown) and a controller 220 in communication with the actuator. The controller 220 is configured operate the actuator so as to selectively cause the outer eccentric component 162 to rotate about the inner eccentric component 162. The result is that moveable member 164 iterates between a retracted configuration, whereby the moveable member 164 or contact surface 165 is disposed toward the central axis 26 along the radial direction R as shown FIG. 11A, and an extended configuration whereby the moveable member 164 or contact surface 165 is at least partly projecting outward away from the central axis 26 along the radial direction R as shown in FIG. 11B. As shown, the contact surface 165 is further away from the central axis 26 when the adjustment assembly 150 is in the extended configuration compared to when the adjustment assembly 150 is in the retracted configuration. The controller 220 can be part of the downhole control system 210 as shown in FIG. 12 and further described below.

Figure 9:
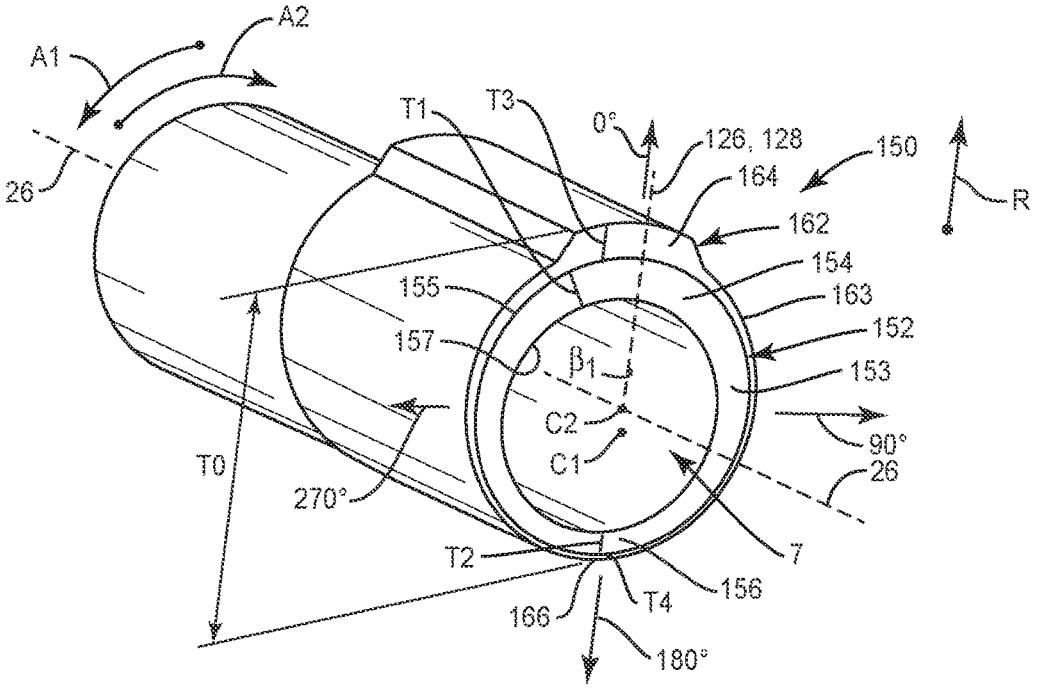
FIGS. 9 and 10 are a perspective end views of a portion of the downhole motor in shown in FIG. 7, illustrating transition of the adjustment assembly.

Continuing with FIGS. 8 and 9, in accordance with the illustrated embodiment, the inner eccentric component 152 includes a body or wall 153 that defines an outer surface 155, and an inner surface 157 opposed to the outer surface 155 along the radial direction R. The wall 153 also defines a first end 158*a*, a second end 158*b* spaced from the first end 158*a* along the central axis 26. The inner surface 157 can define the internal passage 7 within which a portion of the motor assembly 40 is disposed and through which drilling fluid flows toward the drill bit 14. The inner surface 157 also defines an inner cross-sectional shape that is perpendicular to the central axis 26 and is centered about a first center C1 that lies on the central axis 26. The outer surface 155 defines an outer cross-sectional shape that is perpendicular to the central axis 26 and is centered about a second center C2 that is offset from the first center C1. The result is that the inner eccentric component 152, or wall 153, includes a thickness defined from the outer surface 155 to the inner surface 157 that can vary circumferentially about the central axis 26. As illustrated, the wall 153 can include a first or enlarged or thick wall segment 154 and second or thin wall segment 156 that is opposite from the thick wall segment 154. The thick wall segment 154 defines a first thickness T1 that extends from the inner surface 157 to the outer surface 155. The thin wall segment defines a second thickness T2 that extends from the inner surface 157 to the outer surface 155 and is less than the first thickness. The thick wall segment 154 can be oriented in any particular direction as desired. In the illustrated embodiment, the wall segment 154 is disposed such that its maximum thickness is oriented along a first radial axis 126 that intersects the central axis 26 and extends outwardly away from the center C1 in the radial direction.

As can be seen in FIG. 7, the inner component wall or body 153 extends the first end 158*a* to the second end 158*b* along the axis 26 to define component length. The thin wall segment 156 extends along a portion of the length and around a portion of the circumference so as define a recessed portion (not numbered). For instance, the wall 153 has a relatively consistent wall thickness in regions adjacent the first and second ends 158*a* and 158*b*. In this way, the inner eccentric component 152 can be coupled to standard sized housing components, such as the bent housing 139, the uphole housing component 39*c*, or other sections of standard sized drill pipe. The recessed portion is sized and configured carry a portion of the outer eccentric component 162. And depending on what portion of the outer eccentric component 162 is aligned with recess portion define whether the adjustment assembly in the retracted configuration or the extended configuration.

Continuing with FIGS. 8 and 9, the outer eccentric component 162 includes a body 163 that includes a wall 166 and an enlarged segment 164, referred to as the moveable member 164, that extends outwardly away from the wall 166. The moveable member 164 can be disposed along a second radial axis 128 that intersects the central axis 26 and extends outwardly along the radial direction R. In accordance with the illustrated embodiment, the body 163 defines a first end 168*a*, a second end 168*b* spaced from the first end 168*a* along the central axis 26, an outer surface 165, and an inner surface 167 opposed to the outer surface 165 along a radial direction R that is perpendicular to the central axis 26. The inner surface 167 defines an inner cross-sectional shape that is perpendicular to the central axis 26 and is centered about the second center C2 that is offset from the central axis 26. The inner cross-sectional shape of the outer eccentric component 162 conforms to the outer cross-sectional shape of the inner eccentric component 152 so that the outer component 162 is rotatable about the inner component 152. The outer surface 165 of the outer eccentric component 162 defines an outer cross-sectional shape that is perpendicular to the central axis 26 and includes the shape of the moveable member 164. The moveable member 164 can be monolithic with the wall 166. In other configurations, the moveable member 164 can be secured to the wall 166 with a connector. In still other embodiments, a kit can be provide that includes multiple moveable members 164 with different thicknesses that can attached to wall 166 to adjust the extent that the moveable member 164 can extend outwardly from the wall 166. Furthermore, the moveable member 164 can be multiple pieces such that it could be assembled on the wall 166.

Continuing with FIGS. 8 and 9, the outer eccentric component 162 or wall 166 can have a thickness that varies circumferentially about the central axis 26 and along a length aligned with the central axis 26. In accordance with the illustrated embodiment, the enlarged segment 164 defines an enlarged or third thickness T3 that extends from the inner surface 167 to the outer surface 165. The portion of the wall 166 disposed opposite the enlarged segment 164 defines a wall or fourth thickness T4 that extends from the inner surface 157 to the outer surface 155 and is less than the third thickness T3. Wall thicknesses T4 discussed herein can vary between about 0.125 inches about to about 2.0, 3.0, or 4.0 inches, depending on the size of the downhole motor 130. In the illustrated embodiment, the enlarged wall segment 164 is disposed such that its maximum thickness is oriented along the second radial axis 128 that intersects the central axis 26 and extends outwardly away from the center C1 in the radial direction R.

Continuing with FIG. 8, the adjustment assembly 150 includes the attachment members 170 and 172 as discussed above. In accordance with the illustrated embodiment, the attachment members 170 and 172 couple the outer eccentric component 162 to the inner eccentric component 152 such that the outer eccentric component 162 is moveable relative to the inner eccentric component 162 and the attachment members 170 and 172. Connectors 171 and 173, such as fasteners, bolts or welds, couple the attachment members 170 and 172 to the inner eccentric component 162. In alternative embodiments, the attachment members 170 and 172 can be threadably connected to the inner eccentric component 152. Each attachment member 170 and 172 defines gap (not numbered) defined with respect to the outer surface 155 of the inner eccentric component 152. Each attachment member gap receives the respective ends 168*a* and 168*b* of the outer eccentric component 162 so that the ends 168*a* and 168*b* are rotationally moveable within the gaps. This allows the outer eccentric component 162 to rotate about the inner eccentric component 152 yet is secured to downhole motor 30. Either the housing 139 or the attachment member 170 and 172 can include the actuator (not shown). In alternative embodiments, the outer eccentric component 162 can be attached to the inner eccentric component 152 with snap fittings, retaining rings, threads, welding, or the fastening means. Further, the attachment members can be integral with the housing 152. In addition, the motor could include one attachment member on either end of moveable member.

Figure 10:
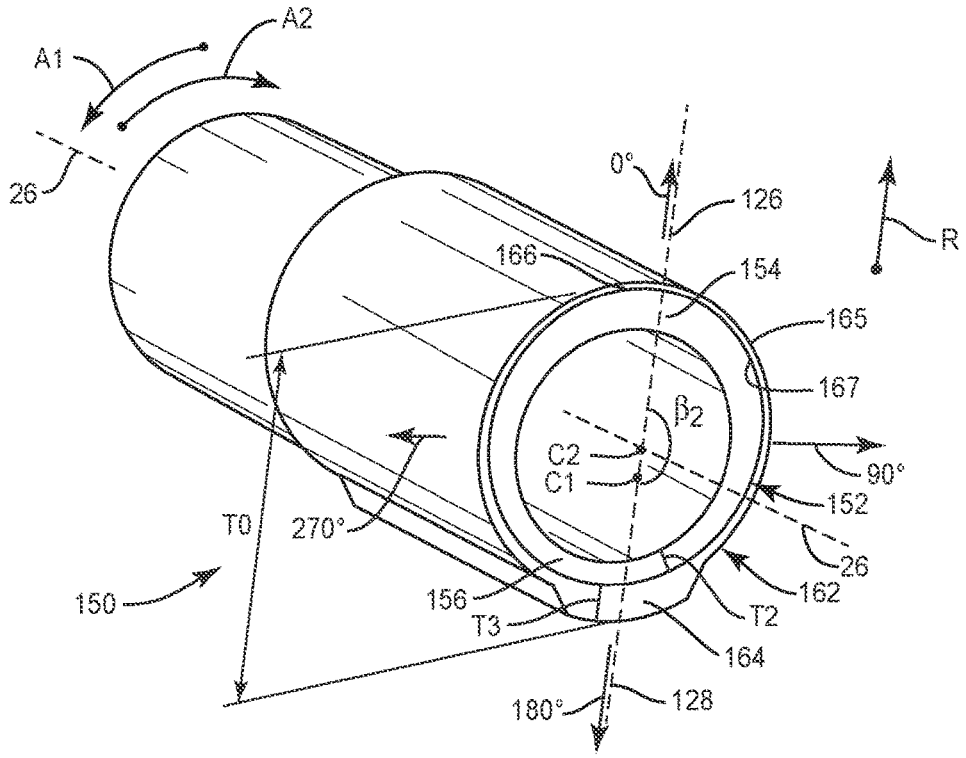
Figure 11A:
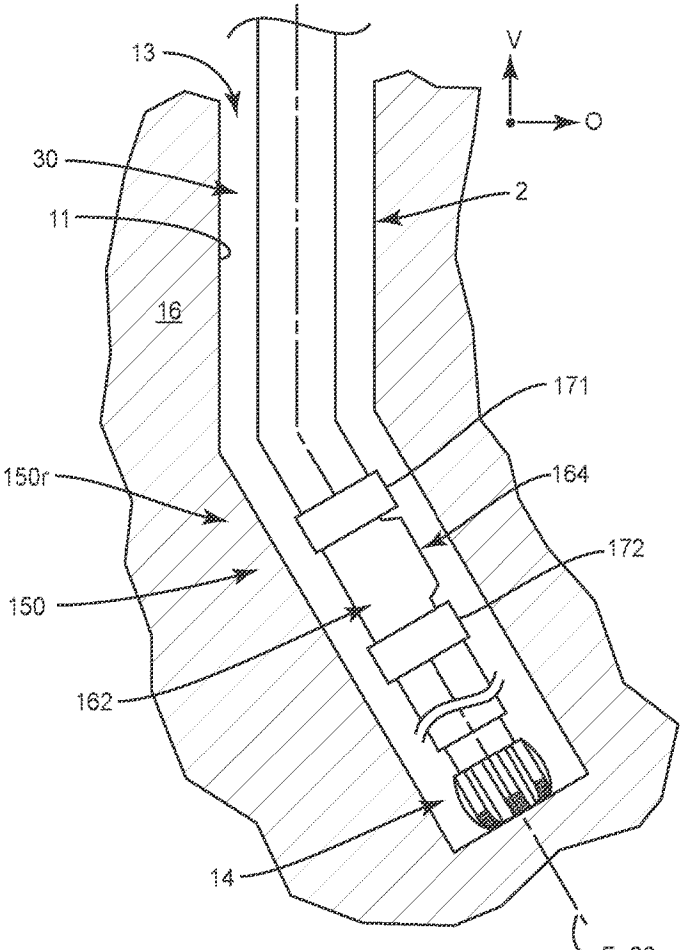

In operation, the outer centric component 162 is configured to change its rotational position relative to the inner eccentric component 152 in order to position the moveable member 164 in either the extended configuration 150*e* as shown in FIGS. 9 and 11B or the retracted configuration as shown in FIGS. 10 and 11A. When the adjustment assembly 150 is in the extended configuration as shown in FIGS. 9 and 11B, the outer eccentric component 162 is in a first rotational position relative to the inner eccentric component 152 such that the moveable member 164 projects outwardly away from the central axis 26. When the adjustment assembly 150 is in the retracted configuration as shown in FIGS. 10 and 11A, the outer eccentric component 162 is in a second rotational position relative to the inner eccentric component 152 that is different from the first rotational position and the moveable member 164 is disposed inwardly toward the central axis 26.

Turning to FIGS. 9 and 11B, when the moveable member 164 is aligned with at least a portion of the enlarged wall segment 154 of the inner component 152, the adjustment assembly 150 is in the extended configuration 150*e*. In the extended configuration, the first radial axis 126 of the inner eccentric component 152 is aligned with the second radial axis 128 of the outer eccentric component 162 such that the first and second radial axes define an angle β1 equal to about 0 (zero) degrees. Angle β1 can vary by several degrees, such as plus or minus 5 to 10 degrees off of 0 (zero) degrees and still cause the moveable member 164 to project outwardly to contact the well wall 11. As illustrated, both the movement member 164 and enlarged segment 154 are oriented at a 0 degree position when in the extended configuration.

Referring now to FIGS. 10 and 11A, the adjustment assembly 150 is in the retracted configuration 150*r* when the moveable member 164 is rotationally offset with respect to the enlarged wall segment 154 of the inner component 152. In the retracted configuration, the first radial axis 126 of the inner eccentric component 152 is offset from the second radial axis 128 of the outer eccentric component 162 when the first and second radial axes define an angle β2 that is greater than 0 (zero) degrees, preferably greater than about 20 degrees. In accordance with the illustrated embodiment, the inner eccentric component 152 is fixed and its enlarged segment 154 is oriented at the 0 degree position. When the adjustment assembly 150 is in the retracted configuration 150*r*, the moveable member 164 is orientated at about the 180 degree position and the angle β2 is also about 180 degrees. In the illustrated configuration, the moveable member 164 is circumferentially opposite to the enlarged wall segment 154 of the inner eccentric component 152.

As described above, an actuator can cause movement of the outer component 162 relative to the inner eccentric component 152. In accordance with one embodiment, the actuator can be a valve and a conduit that is in flow communication with the internal passage 7 of the housing 138. The conduit can extend from the internal passage 7 to an area near one of gaps of the attachment members 170 or 172. The valve can selectively open or close off the conduit in response to inputs from the controller 220. When the valve is open drilling fluid can enter the conduit and apply pressure to a vane disposed along one the ends 168*a* and 168*b* of the outer eccentric component 162. When the valve is open, pressure of the drilling fluid causes the outer eccentric component 162 to rotate relative to the inner eccentric component 152. When the valve is closed the outer eccentric component 162 is rotationally fixed relative to the inner eccentric component 152. It should be appreciated that the actuator can be any type of actuator that can be use used selectively change the rotational position of the outer eccentric component 162 relative to the inner eccentric component 152. For instance, the actuator can be operated by electric motors or hydraulic motors. Motors could be geared to the outer component to affect rotation.

Turning to FIG. 12, the control system 100 can be used operate and control a drilling system that includes the downhole motor 30 and adjustment assembly 50 described above and shown in FIGS. 2-6B as well as a drilling system that includes the downhole motor 130 and the adjustment assembly 150 shown in FIGS. 7-11B. In accordance with the illustrated embodiment, the control system 100 includes a surface control system in the form of one or more computing devices 200 and a downhole control system 210. Inputs from the surface control system can be transmitted to the downhole control system 210 via the telemetry system 250. For instance, inputs for operating the downhole motor 30, 130 can be downlinked from the surface control system to the downhole motor control system 210 via the telemetry system 250. Further, drilling information can be transmitted from the downhole control system 210 to the surface control system.

Any suitable computing device 200 may be configured to host a software application configured to process drilling data encoded in the signals and further monitor and analyze drilling operations, or control the downhole motor 30, 130. It will be understood that the computing device 200 can include any appropriate device, examples of which include a desktop computing device, a server computing device, or a portable computing device, such as a laptop, tablet or smart phone. The computing device 200 includes a processing portion 202, a memory portion 204, an input/output portion 206, and a user interface (UI) portion 208. It is emphasized that the block diagram depiction of the computing device 200 is exemplary and not intended to imply a specific implementation and/or configuration. The processing portion 202, memory portion 204, input/output portion 206 and user interface portion 208 can be coupled together to allow communications therebetween. As should be appreciated, any of the above components may be distributed across one or more separate devices and/or locations.

In various embodiments, the input/output portion 206 includes a receiver of the computing device 200, a transmitter (not to be confused with components of the telemetry tool 22 described above) of the computing device 200, or an electronic connector for wired connection, or a combination thereof. The input/output portion 206 is capable of receiving and/or providing information pertaining to communication with a network such as, for example, the Internet. As should be appreciated, transmit and receive functionality may also be provided by one or more devices external to the computing device 200. For instance, the input/output portion 206 can be in electronic communication with the receiver.

Depending upon the exact configuration and type of processor, the memory portion 204 can be volatile (such as some types of RAM), non-volatile (such as ROM, flash memory, etc.), or a combination thereof. The computing device 200 can include additional storage (e.g., removable storage and/or non-removable storage) including, but not limited to, tape, flash memory, smart cards, CD-ROM, digital versatile disks (DVD) or other optical storage, magnetic cassettes, magnetic tape, magnetic disk storage or other magnetic storage devices, universal serial bus (USB) compatible memory, or any other medium which can be used to store information and which can be accessed by the computing device 200.

The computing device 200 can contain the user interface portion 208, which can include an input device and/or display (input device and display not shown), that allows a user to communicate with the computing device 200. The user interface 208 can include inputs that provide the ability to control the computing device 200, via, for example, buttons, soft keys, a mouse, voice actuated controls, a touch screen, movement of the computing device 200, visual cues (e.g., moving a hand in front of a camera on the computing device 200), or the like. The user interface 208 can provide outputs, including visual information. Other outputs can include audio information (e.g., via speaker), mechanically (e.g., via a vibrating mechanism), or a combination thereof. In various configurations, the user interface 208 can include a display, a touch screen, a keyboard, a mouse, an accelerometer, a motion detector, a speaker, a microphone, a camera, or any combination thereof. The user interface 208 can further include any suitable device for inputting biometric information, such as, for example, fingerprint information, retinal information, voice information, and/or facial characteristic information, for instance, so as to require specific biometric information for access to the computing device 200.

The downhole control system 210 can include the downhole motor controller 220. The controller 220 contains a processor 230 in electronic communication with an actuator 54 (or actuator used with adjustment assembly 150). Although not shown, the controller 220 can include volatile or non-volatile memory and an input/output portion in the form receiver, transmitter, and/or transceiver. The input/output portion is configured to receive information or signals from the surface control system or MWD tool 22. The signals can be include inputs, such as instructions to cause the actuator to iterate the adjustment assembly 50, 150 between retracted configuration and the extended configuration as described above. For instance, the controller 220 can, in response to inputs from surface control system or based on a predefined drilling plan stored in the memory portion of the controller 220, cause the valve to direct drilling fluid to the engagement member 58, thereby cause the moveable member 52 to move into the extended configuration. Further inputs can direct the controller 220 to close of flow communication between the drilling fluid and the engagement member 58 so the moveable member 52 is moved into the retracted configuration. Furthermore, the controller is configured to cause movement of the moveable member in response to predetermined fluctuations in drilling parameters, such as the flow rate, drilling fluid pressure, WOB, and rotational speed of the drill bit and/or drill string.

Another embodiment of the present disclosure includes a method for guiding a drilling direction of a drill bit 14 during a drilling operation. Initially, the bottom hole assembly 12 is assembled such the drill bit 14 is coupled the downhole motor 30. The drill bit 14 and downhole motor 30 can be lowered into the casing at the initial stages of well formation. Thereafter the MWD and LWD tools are added and the bottom hole assembly 12 and drill bit 14 are advanced further into the formation. AdditionAL tools or sections of drill pipe are added to the drill 6. The surface control system cause the surface motors rotate the drill string 6 to drill the well 2 into the earthen formation 3 until the planned turn. At initial stages or leading up the turn stage both drill string 6 and the drill bit 14 are rotating with via operation of the surface and downhole motors. In accordance with embodiments described above, the drill bit is coupled to the downhole motor 30, 130 such that the drill bit 14 is oriented along a first direction that is angularly offset relative to at least a portion of the drill string 6 and or downhole motor 30. At the start of the turn, inputs into the surface control system causes rotation of the drill string in the well to stop. At this stage, the drilling system 1 transitions from the rotary drilling mode into a sliding mode whereby only the drill bit 14 rotates and the drill string 6 slides along the well 2. The bit may continue rotation when the drill string 6 stops rotating or the both the drill string 6 and drill bit 14 may stop rotating. At this point, an MWD survey can be conducted or some other maintenance event can occur. In event, at some point, the method includes the step of rotating the drill bit via the downhole motor 30, 130 while rotation of drill string 6 in the well 2 has stopped. The method can include actuating an adjustment assembly 50, 150 carried by the downhole motor 30,130 toward a wall 11 of the well in a second direction that is opposite to the first direction, thereby causing a reactive force to guide the drill bit along the first direction. As noted above, the step of actuating the adjustment assembly 50,150 includes causing a moveable member 52,164 to move between the extended configuration where the moveable member 52, 164 projects outward from the downhole motor 30, 130 to contact the wall 11 of the well, and the retracted configuration where the moveable member 52,164 is disposed at least partially in the downhole motor 30, 130. It should be appreciated that the step of actuating an adjustment assembly 50 includes causing the moveable member 52 to pivot or alternatively translate into the extended configuration. The step of actuating an adjustment assembly 50, 150 includes causing, via the controller 220, the actuator to transition the adjustment assembly 50, 150 from the retracted configuration into the extended configuration.

With respect to downhole motor 130 and the adjustment assembly 150, actuating the adjustment assembly 150 into the extended configuration includes rotating at least one of the first and second components 152 and 162 relative to the other of the first and second components 152 and 162 such that the enlarged segment 154 and the enlarged segment 164 (sometimes referred to as the moveable member 164) are at least partially aligned with each other. Further actuating the adjustment assembly 150 from the extended configuration into the retracted configuration causes that the enlarged segments 154 and 164 to move out of alignment with each other. Thereafter, the rotary drilling can resume when the desired direction is attained.

Figure 13:
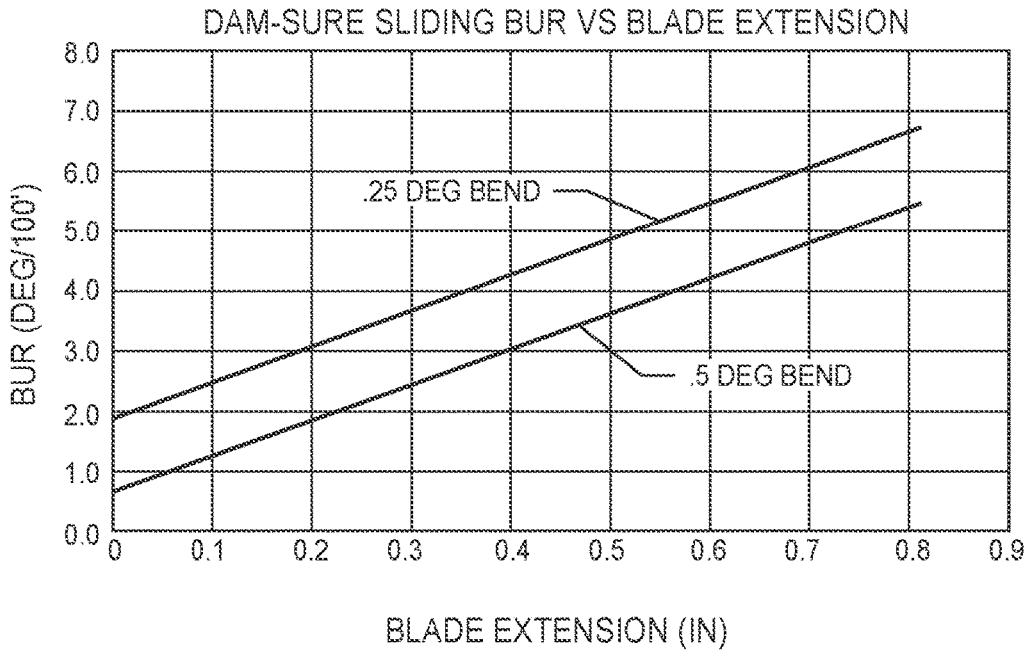
FIG. 13 is a chart illustrates with exemplary data indicating the relationship between the extension characteristics of an adjustment assembly and the build-up rate of the drilling system illustrated in FIG. 1.

Turning now to FIG. 13 illustrates an exemplary data set utilizing one the downhole motors 30, 130 as described above to steer the drill bit 14. The Y-axis is the BUR and the X-axis is the moveable member extension (E1, E2) in inches. Extension is distance from the outer surface of the housing 38, 138 to an outermost point of the moveable member 52, 164 (FIGS. 6B, 11B). During drilling the downhole motor 30 slides like a conventional motor to build the turn and rotate again like a conventional motor to drill straight. The advantage is that downhole motor 30, 130 has a small bend which does not create excessive stress in the tools when rotated as opposed to conventional motors which are often rotated with 2 degree plus bends. Because drillers want the high build potential of a "large" bends, i.e. when a is between about 1.75 degrees to 3 degrees or higher, to quickly affect directional corrections. As noted above, drillers want to maximize the amount of time during the drilling operation that the drill string 6 rotates so as to optimize ROP. The adjustment assembly 50, 150 of the present disclosure can utilize relative to small bend angles to prevent excessive stress on the tools while rotating and yet deploy or extend the moveable member 52, 164 during sliding modes to rapidly affect directional changes in the drill bit 14 and realize a higher BUR. The BUR rate was calculated using the 3-point curvature BUR well known to those of skill in the art. As can be seen in the graph of FIG. 13, when the downhole motor 30,130 has a bend angle of about 0.10 degrees, up to 0.8 inches of blade extension E1, E2 results in a BUR of 6 degrees/100 feet. For the same tool using no blade extension, the BUR is just below 2 degrees/100 feet. When the downhole motor 30,130 include a bend angle about 0.5 degrees, up to 0.8 inches of blade extension E1, E2 results in a BUR rate of about 5.5 degrees/100 feet. For the same downhole motor without any blade extension, the BUR is just below 1 degree/100 feet.

What is claimed is:

1. A downhole motor configured to operate a drill bit to drill a well into an earthen formation, the downhole motor comprising:

a motor housing including an uphole portion, a downhole portion that extends relative to the uphole portion in a downhole direction away from the uphole portion, and at least one bend defined by the motor housing and located between the uphole portion and the downhole portion such that the downhole portion is angularly offset with respect to the uphole portion, wherein the motor housing is configured to orient the drill bit in a direction that is offset with respect to the uphole portion of the motor housing when the drill bit is coupled to the downhole motor; and a motor assembly including a stator supported by an inner surface of the motor housing and a rotor operably coupled to the stator, the rotor configured to be operably coupled to the drill bit and to cause rotation of the drill bit as a fluid passes through the motor housing; and an adjustment assembly including a contact surface, an actuator coupled to the contact surface, and a controller operatively coupled to the actuator, the controller being configured to, in response to an input received from a surface of the earthen formation, automatically cause the actuator to transition the adjustment assembly between a retracted configuration where the contact surface is aligned with a portion of the motor housing, and an extended configuration where the contact surface extends outwardly away from the motor housing, wherein the adjustment assembly is configured to transition between the retracted configuration and the extended configuration while fluid passes through the motor housing to rotate the drill bit.

2. The downhole motor of claim 1, wherein the adjustment assembly is proximate the at least one bend.

3. The downhole motor of claim 1, wherein the motor housing includes a bent sub that includes the at least one bend.

4. The downhole motor of claim 1, wherein when the adjustment assembly is in the extended configuration, the contact surface extends toward a well wall along a first direction, thereby causing a reactive force to guide the drill bit coupled to the downhole motor in the second direction that is opposite to the first direction.

5. The downhole motor of claim 1, further comprising a movable member that carries the contact surface, wherein the actuator includes a valve and an engagement member moveably coupled to the valve, where the valve is configured to selectively cause the engagement member to move the moveable member between the retracted configuration and the extended configuration.

6. The downhole motor of claim 5, wherein the actuator is responsive to a fluid so as to cause the moveable member to transition between the retracted configuration and the extended configuration.

7. The downhole motor of claim 5, wherein the moveable member is an arm that includes the contact surface, and an engagement surface opposed to the contact surface, wherein the engagement member is configured to abut the engagement surface to cause the arm to transition from the retracted configuration to the extended configuration.

8. The downhole motor of claim 5, wherein the moveable member is configured to pivot so as to transition between the retracted configuration and the extended configuration.

9. The downhole motor of claim 5, wherein the moveable member is configured to translate so as to transition between the retracted configuration and the extended configuration.

10. The downhole motor of claim 5, wherein the moveable member is configured to rotate so as to transition between the retracted configuration and the extended configuration.

11. The downhole motor of claim 10, wherein the adjustment assembly includes a first component and a second component that at least partially surrounds the first component, wherein at least one of the first component and the second component is rotatable relative to the other of the first component and the second component.

12. The downhole motor of claim 11, wherein the first component and the second component each include an enlarged segment, wherein when the adjustment assembly is in the extended configuration the enlarged segments are at least partially aligned with each other, and when the adjustment assembly is in the retracted configuration the enlarged segments are rotationally offset with respect to each other.

13. The downhole motor of claim 12, wherein the enlarged segment of the second component includes the contact surface.

14. The downhole motor of claim 11, wherein the first and second components are eccentrically disposed relative to each other.

15. The downhole motor of claim 11, wherein the second component is rotatably coupled to the actuator.

16. The downhole motor of claim 11, wherein the first component defines a portion of the motor housing.

17. The downhole motor of claim 5, wherein the adjustment assembly includes a moveable member coupled to the actuator, wherein the controller is configured to cause the actuator to transition the moveable member between the retracted configuration and the extended configuration.

18. The downhole motor of claim 1, wherein the uphole portion that extends along a first axis and the downhole portion that extends along a second axis that intersects and is angularly offset with respect to the first axis.

19. The downhole motor of claim 18, where the first axis and the second axis defines a bend angle therebetween, wherein the bend angle is up to about 5.0 degrees.

20. The downhole motor of claim 19, wherein the bend angle is between about 0.10 degrees and about 4.0 degrees.

21. The downhole motor of claim 19, wherein the bend angle is between about 0.10 degrees and about 3.0 degrees.

22. The downhole motor of claim 1, wherein the adjustment assembly is configured to automatically transition between the retracted configuration and the extended configuration.

23. The downhole motor of claim 1, further comprising a motor assembly disposed within a cavity defined by the uphole portion of the motor housing.

24. A method for controlling a drilling direction during a drilling operation that drills a well into an earthen formation, the method comprising:

rotating a drill string so as to drill the well into the earthen formation;

causing rotation of the drill string in the well to stop;

rotating the drill bit via a downhole motor that includes one or more bends that offsets the drill bit with respect to the drill string, wherein rotation of the drill bit occurs while rotation of drill string in the well has stopped;

actuating an adjustment assembly carried by the downhole motor such that a moveable member moves from a retracted configuration to an extended configuration, wherein a contact surface defined by the moveable member extends toward a wall of the well in a first direction when the moveable member is in the extended configuration so as to guide the drill bit along a second direction that is opposite to the first direction; and rotating the drill bit via the downhole motor with the moveable member in the extended configuration, wherein rotation of the drill bit occurs while rotation of the drill string has stopped.

25. The method of claim 24, wherein the step of actuating the adjustment assembly includes causing the moveable member to move from the retracted configuration where the contact surface is disposed aligned with the downhole motor and the extended configuration where the contact surface projects outwardly from the downhole motor.

26. The method of claim 25, wherein the step of actuating an adjustment assembly includes causing the moveable member to pivot into the extended configuration.

27. The method of claim 25, wherein the actuating step includes causing the moveable member to translate into the extended configuration.

28. The method of claim 25, wherein the actuating step includes causing the moveable member to rotate into the extended configuration.

29. The method of claim 28, wherein the adjustment assembly includes a first component and a second component carried by the first component, the first component and the second component each include an enlarged segment, wherein the actuating step includes rotating at least one of the first component and the second component relative to the other of the first component and the second component such that the enlarged segments are at least partially aligned with each other.

30. The method of claim 29, further comprising the step of further actuating the adjustment assembly from the extended configuration into the retracted configuration so that the enlarged segments are rotationally offset with respect to each other.

31. The method of claim 25, wherein the step of actuating an adjustment assembly includes causing, via a controller in electronic communication with an actuator, the actuator configured to transition the adjustment assembly from the retracted configuration into the extended configuration.

32. The method of claim 31, wherein the step of actuating the adjustment assembly includes causing the actuator to move a moveable member from the retracted configuration into the extended configuration.

33. The method of claim 32, wherein the step of actuating the adjustment assembly includes causing the actuator to move an engagement head of the actuator into contact with a portion of a moveable member so as to move the moveable member from the retracted configuration into the extended configuration.

34. The method of claim 24, further comprising the step of pumping a fluid through a stator and rotor assembly of the downhole motor to cause rotation of the drill bit.

35. The method of claim 24, wherein the actuating step is performed automatically.

36. The method of claim 24, wherein the downhole motor includes a motor assembly disposed within a cavity defined by an uphole portion of the downhole motor.

* * * * *